US010920378B2

(12) United States Patent
Meyers et al.

(10) Patent No.: US 10,920,378 B2
(45) Date of Patent: Feb. 16, 2021

(54) STAMPED STEEL DETECTABLE WARNING TILE AND METHOD OF MANUFACTURE

(71) Applicant: TUF-TITE, INC., Lake Zurich, IL (US)

(72) Inventors: Theodore W. Meyers, Barrington, IL (US); Samuel J. Gerrits, Pewaukee, WI (US); John Fairbanks, Slinger, WI (US); Mike Boyden, Elkhorn, WI (US); Craig Stefan, Hartland, WI (US); Michael C. Ruediger, Oconomowoc, WI (US); Phillip Legreid, Janesville, WI (US); Derek Macdonald, Oconomowoc, WI (US)

(73) Assignee: TUF-TITE, INC., Lake Zurich, IL (US)

( * ) Notice: Subject to any disclaimer, the term of this patent is extended or adjusted under 35 U.S.C. 154(b) by 0 days.

(21) Appl. No.: 16/251,689

(22) Filed: Jan. 18, 2019

(65) Prior Publication Data

US 2019/0226158 A1 Jul. 25, 2019

Related U.S. Application Data

(60) Provisional application No. 62/619,405, filed on Jan. 19, 2018.

(51) Int. Cl.
*E01C 9/10* (2006.01)
*B21D 47/00* (2006.01)
(Continued)

(52) U.S. Cl.
CPC ..... *E01C 9/10* (2013.01); *B21D 22/02* (2013.01); *B21D 37/10* (2013.01); *B21D 47/005* (2013.01);
(Continued)

(58) Field of Classification Search
CPC ... E01C 5/16; E01C 9/10; E01C 11/24; B21D 22/02; B21D 37/10; B21D 47/005; A61H 3/066
(Continued)

(56) References Cited

U.S. PATENT DOCUMENTS 331,469 A 12/1885 Baker
1,334,895 A 3/1920 Irons
(Continued)

FOREIGN PATENT DOCUMENTS

AU 21483/35 2/1935
CA 2032532 A1 12/1991
(Continued)

OTHER PUBLICATIONS

Sullivan, "Beyong the RFID Mandate: Snack Maker Sees Wal-Mart's RFID Requirements as Way to Update Neglected Supply-Chain Processes," Information Week (2004). Retreived from the Internet on Jul. 14, 2010: URL:http://www.informationweek.com/story/showArticle.jhtml?articleID=49400314.
(Continued)

*Primary Examiner* — Raymond W Addie
(74) *Attorney, Agent, or Firm* — Marshall, Gerstein & Borun LLP

(57) ABSTRACT

A stamped steel detectable warning tile and method of forming such includes preforming structures in the tile and subsequently coining the structures to form tactile portions to provide satisfactory end results. Further, the tactile portions can be formed in a staggered fashion along a press to distribute tonnage and extend the lifespan of the press, as well as control a curvature of the tile due to the press operations.

44 Claims, 39 Drawing Sheets

(51) Int. Cl.

| | |
|---|---|
| ***B21D 37/10*** | (2006.01) |
| ***E01C 11/24*** | (2006.01) |
| ***B21D 22/02*** | (2006.01) |
| ***E01C 5/16*** | (2006.01) |
| *A61H 3/06* | (2006.01) |

(52) U.S. Cl.
CPC ..... *E01C 5/16* (2013.01); *E01C 11/24* (2013.01); *A61H 3/066* (2013.01)

(58) Field of Classification Search
USPC ..... 404/9, 19–21, 72
See application file for complete search history.

(56) References Cited

U.S. PATENT DOCUMENTS

D89,809 S 5/1933 Von Till
1,916,631 A 7/1933 Muchnic
D93,650 S 10/1934 Fleisch
2,032,532 A 3/1936 Eck
2,070,984 A 2/1937 Collins
D105,858 S 8/1937 Fleisch
D106,187 S 9/1937 Fleisch
2,153,347 A 4/1939 Schenck
2,421,171 A 5/1947 Trautvetter
3,140,510 A 7/1964 Curtis
3,220,527 A 11/1965 Curtis
3,418,781 A 12/1968 Penote
3,726,376 A 4/1973 Gotham et al.
3,894,634 A 7/1975 Gotham et al.
3,950,908 A 4/1976 Van Eyk
4,080,087 A * 3/1978 Phillips ..... E01C 9/00 404/72
4,128,357 A 12/1978 Barth et al.
4,203,268 A 5/1980 Gladden, Jr. et al.
4,380,996 A 4/1983 Mengeringhausen
4,411,121 A 10/1983 Blacklin et al.
4,490,069 A 12/1984 Cushman et al.
4,554,955 A 11/1985 von Lersner et al.
4,628,549 A 12/1986 Lazar
4,674,251 A 6/1987 Wolff
D291,868 S 9/1987 Hindle
4,715,743 A 12/1987 Schmanski
4,785,945 A 11/1988 Rowse et al.
5,217,319 A * 6/1993 Klohn ..... A61H 3/066 340/407.1
5,255,802 A 10/1993 Krinke et al.
5,271,690 A 12/1993 Fennessy, Sr.
5,281,459 A 1/1994 Van Eijck
5,302,049 A 4/1994 Schmanski
5,303,669 A 4/1994 Szekely
5,320,790 A 6/1994 Lowe
5,328,293 A 7/1994 Keefe
5,386,782 A 2/1995 Dinis et al.
5,478,990 A 12/1995 Montanari et al.
5,499,888 A 3/1996 Hawkes
5,526,766 A 6/1996 Armstrong et al.
5,616,650 A 4/1997 Becker et al.
5,637,641 A 6/1997 Becker et al.
D382,353 S 8/1997 Berger
D385,977 S 11/1997 Berger
5,733,997 A 3/1998 Becker et al.
5,741,878 A 4/1998 Becker et al.
D394,320 S 5/1998 Berger
5,750,628 A 5/1998 Becker et al.
5,755,527 A 5/1998 Dufresne
5,767,218 A 6/1998 Becker et al.
5,775,835 A 7/1998 Szekely
5,788,090 A 8/1998 Kajiwara
5,807,954 A 9/1998 Becker et al.
5,827,009 A 10/1998 Kokoletsos
5,838,238 A 11/1998 Abita et al.
5,840,396 A 11/1998 Betz
5,845,580 A 12/1998 Muller et al.
5,927,034 A 7/1999 Cole
5,933,082 A 8/1999 Abita et al.
5,951,228 A 9/1999 Pfeiffer et al.
D419,862 S 2/2000 Berger
6,074,127 A 6/2000 Suetsugu
6,153,282 A 11/2000 Dickinson et al.
6,153,828 A 11/2000 Murata et al.
6,173,653 B1 1/2001 Edelmann
D438,784 S 3/2001 Berger
6,273,657 B1 8/2001 Vorona
D451,682 S 12/2001 Jahner et al.
D462,791 S 9/2002 Sweeting-McCombs et al.
6,449,790 B1 9/2002 Szekely
6,450,728 B1 9/2002 Grahmbeek et al.
6,453,630 B1 9/2002 Buhrts et al.
6,470,613 B1 10/2002 Wildrick
6,485,226 B1 11/2002 Harger
6,488,618 B1 12/2002 Paolitto et al.
D468,844 S 1/2003 Montgomery, Sr.
D487,700 S 3/2004 Bourque et al.
6,699,553 B1 3/2004 Koket
6,709,191 B1 3/2004 McCuskey
6,718,714 B1 4/2004 Montgomery, Sr.
6,724,309 B2 4/2004 Grose et al.
6,740,388 B1 5/2004 Koket
6,802,159 B1 10/2004 Kotler
6,890,124 B2 5/2005 Provenzano, III
6,895,622 B2 5/2005 Szekely
6,939,078 B1 9/2005 Anderson et al.
6,951,435 B1 10/2005 Fennessy, Sr.
6,951,436 B2 10/2005 Stegemeier et al.
6,960,989 B1 11/2005 Grayson
6,964,244 B2 11/2005 Stockton
6,971,818 B1 12/2005 Schabacker
6,979,317 B2 12/2005 Galt et al.
7,000,279 B2 2/2006 Szekely
7,000,361 B1 2/2006 Merriman et al.
7,001,103 B2 2/2006 Sippola
7,052,495 B2 5/2006 Smith
7,083,845 B2 8/2006 Graff
7,114,298 B2 10/2006 Kotler
7,121,048 B1 10/2006 Merriman et al.
7,124,897 B2 10/2006 Bustos
D532,122 S 11/2006 Shuman et al.
7,142,095 B1 11/2006 Grayson
7,182,548 B1 2/2007 Womack
7,189,025 B1 * 3/2007 Greer ..... E01C 5/20 404/19
D542,655 S 5/2007 Szczesniak
7,223,048 B1 5/2007 Greer et al.
7,249,911 B2 7/2007 Hyams
7,267,281 B2 9/2007 Hopkins
D556,921 S 12/2007 Ardern
7,438,694 B2 10/2008 Boozer et al.
D606,401 S 12/2009 Kamath et al.
7,674,066 B2 3/2010 Wehmeyer
7,690,862 B2 4/2010 Szekely
7,758,279 B2 7/2010 Driscoll
7,779,581 B2 * 8/2010 Flaherty ..... E01C 5/20 116/205
7,845,122 B2 12/2010 Sippola
7,992,360 B2 8/2011 Driscoll
7,993,074 B1 8/2011 Driscoll
8,028,491 B2 10/2011 Flaherty et al.
D648,238 S 11/2011 Niver et al.
8,146,302 B2 4/2012 Sippola
8,192,623 B2 6/2012 Reid et al.
D679,031 S 3/2013 Amend
8,439,596 B1 5/2013 Dvoracek
D691,473 S 10/2013 Smith et al.
D691,743 S 10/2013 Meyers
8,630,435 B2 1/2014 Mellow et al.
D700,369 S 2/2014 Meyers
8,920,066 B1 * 12/2014 Meyers ..... E01C 5/20 404/18
9,033,612 B2 5/2015 Szekely et al.
D744,668 S 12/2015 Meyers
9,311,831 B2 4/2016 Henshue et al.
9,365,984 B2 6/2016 Flaherty et al.
D780,346 S 2/2017 Meyers

(56) References Cited

U.S. PATENT DOCUMENTS

| | | | | |
|---|---|---|---|---|
| D796,073 | S | 8/2017 | Meyers | |
| 9,770,383 | B1 * | 9/2017 | Meyers | A61H 3/066 |
| 9,789,025 | B2 | 10/2017 | Henshue et al. | |
| D858,805 | S | 9/2019 | Meyers | |
| D869,693 | S | 12/2019 | Meyers | |
| 2002/0149570 | A1 | 10/2002 | Knowles et al. | |
| 2003/0037720 | A1 | 2/2003 | Stockton | |
| 2003/0084523 | A1 | 5/2003 | Szekely | |
| 2004/0042850 | A1 * | 3/2004 | Provenzano, III | A61H 3/066 404/34 |
| 2004/0067336 | A1 | 4/2004 | Munroe | |
| 2004/0178156 | A1 | 9/2004 | Knorring et al. | |
| 2005/0013662 | A1 | 1/2005 | Provenzano | |
| 2005/0031415 | A1 | 2/2005 | Sippola | |
| 2005/0066623 | A1 | 3/2005 | Sippola | |
| 2005/0144743 | A1 | 7/2005 | Szekely | |
| 2005/0265782 | A1 | 12/2005 | Everett | |
| 2006/0024132 | A1 | 2/2006 | Seman | |
| 2006/0037155 | A1 | 2/2006 | Szekely | |
| 2006/0039752 | A1 * | 2/2006 | Hyams | E01C 19/44 404/19 |
| 2006/0108426 | A1 | 5/2006 | Hopkins | |
| 2006/0174567 | A1 | 8/2006 | Sippola | |
| 2006/0188680 | A1 | 8/2006 | Everett | |
| 2006/0210766 | A1 | 9/2006 | Press et al. | |
| 2006/0227009 | A1 | 10/2006 | Koehn | |
| 2006/0245827 | A1 * | 11/2006 | Rydin | A61H 3/066 404/9 |
| 2007/0028531 | A1 | 2/2007 | Woodcock | |
| 2007/0059441 | A1 | 3/2007 | Greer | |
| 2007/0086859 | A1 | 4/2007 | Julnes | |
| 2007/0092335 | A1 | 4/2007 | Wehmeyer | |
| 2007/0196169 | A1 | 8/2007 | Logan et al. | |
| 2007/0201948 | A1 * | 8/2007 | Harward | E01F 11/00 404/15 |
| 2007/0201949 | A1 * | 8/2007 | Veldboom | E01C 11/24 404/19 |
| 2007/0212190 | A1 | 9/2007 | Monday et al. | |
| 2007/0269264 | A1 | 11/2007 | Boghossian | |
| 2008/0008526 | A1 | 1/2008 | Boghossian | |
| 2008/0016740 | A1 | 1/2008 | Mitten et al. | |
| 2008/0047909 | A1 | 2/2008 | Hamaji et al. | |
| 2008/0229703 | A1 | 9/2008 | Driscoll | |
| 2008/0280097 | A1 | 11/2008 | Flaherty et al. | |
| 2009/0130962 | A1 | 5/2009 | Willburger et al. | |
| 2010/0133219 | A1 | 6/2010 | Sun | |
| 2010/0313502 | A1 | 12/2010 | Flaherty et al. | |
| 2011/0185961 | A1 | 8/2011 | Flaherty et al. | |
| 2012/0017823 | A1 | 1/2012 | Flaherty et al. | |
| 2012/0073492 | A1 | 3/2012 | Flaherty et al. | |
| 2012/0076579 | A1 | 3/2012 | Flaherty et al. | |
| 2012/0076580 | A1 | 3/2012 | Flaherty et al. | |
| 2012/0124936 | A1 | 5/2012 | Flaherty et al. | |
| 2012/0275858 | A1 * | 11/2012 | Szekely | A61H 3/066 404/22 |
| 2014/0099164 | A1 * | 4/2014 | Sippola | A61H 3/066 404/45 |
| 2015/0265491 | A1 * | 9/2015 | Henshue | E01C 5/001 404/19 |
| 2018/0055716 | A1 | 3/2018 | Flaherty | |

FOREIGN PATENT DOCUMENTS

| | | | |
|---|---|---|---|
| CA | 2070984 | A1 | 6/1992 |
| CA | 2092367 | A1 | 9/1994 |
| DE | 195 00 326 | A1 | 7/1996 |
| DE | 10 2005 032 678 | A1 | 1/2007 |
| DE | 20 2006 000 282 | U1 | 5/2007 |
| EP | 0 425 901 | A1 | 5/1991 |
| EP | 0 484 705 | A1 | 5/1992 |
| EP | 1 356 752 | B1 | 3/2006 |
| EP | 1 289 374 | B1 | 7/2007 |
| EP | 2 062 478 | B1 | 10/2009 |
| GB | 379690 | A | 8/1932 |
| GB | 433732 | A | 8/1935 |
| GB | 486128 | A | 5/1938 |
| JP | 8-299121 | A | 11/1996 |
| WO | WO-97/26533 | A1 | 7/1997 |
| WO | WO-99/30597 | A1 | 6/1999 |
| WO | WO-01/91565 | A1 | 12/2001 |
| WO | WO-2007/033294 | A2 | 3/2007 |
| WO | WO-2007/050527 | A3 | 6/2007 |
| WO | WO-2009097655 | A1 | 8/2009 |
| WO | WO-2010062985 | A1 | 6/2010 |

OTHER PUBLICATIONS

Engineered Plastics, Inc.'s Drawing No. ADA-C-1212 published on Engineered Plastics' website at least as early as May 2001.

Engineered Plastics, Inc.'s Drawing No. ADA-P044-BA4-24M published on Engineered Plastics' website at least as early as May 2001.

Engineered Plastics, Inc.'s Drawing No. ADT-S203-GEN2-06X48 published on Engineered Plastics' website at least as early as May 2001.

Engineered Plastics, Inc.'s Drawing No. ADA-C-1212 published on Engineered Plastics' website at least as early as Apr. 2004.

TufTile—News—ADA Detectable Warning Products (on-line), dated Mar. 4, 2016. Retrieved from Internet Dec. 13, 2018, URL: http://www.tuftile.com/index.php/news (5 pages) (Year: 2016).

ADA Tiles and Mats (on-line), dated Jun. 16, 2016. Retrieved from Internet Dec. 13, 2018, URL: https://web.archive.org/web/20160616113748/https://www.transpo.conn/connponent/k2/itenn/68-ada-tiles-and-mats (1 page) (Year: 2016).

* cited by examiner

STAMPED STEEL DETECTABLE WARNING TILE AND METHOD OF MANUFACTURE

FIELD OF THE DISCLOSURE

This application claims the benefit of U.S. Application No. 62/619,405, filed Jan. 19, 2018, which is hereby incorporated by reference herein in its entirety.

FIELD OF THE DISCLOSURE

The present disclosure relates to detectable warning products and, more particularly, to detectable warning tiles.

BACKGROUND

Conventional detectable warning tiles are typically made of a polymer material or cast iron. Polymer tiles, while relatively easy to form using injection molding, for example, may have a relatively short lifetime due to physical damage, which can occur when subjected to sidewalk cleaning, snow shoveling, or impact from snow plow blades. Cast iron, while relatively tougher than a polymer, can present other problems. Cast iron tiles can be brittle, causing the tiles to break or shatter when subjected to large shearing forces. Further, cast iron tiles may be incompatible with surface mounting techniques, limiting usefulness for some applications. Finally, cast iron tiles tend to be extremely heavy, rendering the tiles more burdensome to transport and install.

Due to these drawbacks, steel would seemingly provide an advantageous material in the manufacture of tactile warning tiles given its properties. It has been found, as presented below, however, that trying to utilize steel for creating a detectable warning tile poses many problems. For example, if the material is too hard, the features may not form as desired. Further, forming steel requires a substantial tonnage and may bow or warp the material to an undesirable shape. Conversely, if the material is too thick, the tonnage required is even more substantial and tool modifications may be required to accommodate the extra thickness.

SUMMARY

A method, progressive die, stamped steel detectable tile, and a stretching assembly for a stamped steel detectable tile are described herein.

A method for forming a detectable warning tile from a sheet of steel using a progressive die includes feeding the sheet of steel through the progressive die using a feeding mechanism, preforming structures across a width and length of the sheet of steel using one or more first workstations of the progressive die, and coining the structures to form an array of tactile portions in the sheet of steel using one or more second workstations of the progressive die.

Coining the structures can include forming nibs in a top surface of each of the tactile portions.

Coining the structures to form the array of tactile portions can further or alternatively include coining a portion of the structures to form truncated domes. In further embodiments, coining the structures to form the array of tactile portions can also include coining a second portion of the structures to form a plurality of radial tactile portions that extend radially away from each of the truncated domes.

Preforming the structures across the width and length of the sheet of steel can include using a plurality of first workstations, where each of the plurality of first workstations has one or more punch and die pairs disposed so as to distribute the performing of the structures along a length and width of the progressive die.

Coining the structures can include using a plurality of second workstations, where each of the plurality of second workstations has one or more punch and die pairs disposed so to distribute the coining of the structures along a length and width of the progressive die.

The method can include one or more of: leveling the sheet of steel by forming a leveling rib extending across the width of the sheeting of steel; stretching the detectable warning tile to reduce or remove stresses in the steel resulting from the preforming and coining steps; or punching pilot holes in lateral edge portions of the sheet of steel at a workstation of the progressive die with pilot punches and registering the sheet of steel with registering punches extending through the pilot holes at one or more downstream workstations of the progressive die.

A progressive die that is configured to form a detectable warning tile from a sheet of steel is described herein that includes one or more first workstations and one or more second workstations. Preforming punch and die pairs of the one or more first workstations are configured to form preform structures across a width and length of the sheet of steel. Coining punch and die pairs of the one or more second workstations are configured to coin the preform structures to form an array of tactile portions in the sheet of steel.

Dies of the coining punch and die pairs can include recesses configured to form nibs in a top surface of the tactile portions.

A first combination of individual members of the preforming punch and die pairs and individual members of the coining punch and die pairs can be configured to form truncated domes in the sheet of steel. In further embodiments, a second combination of individual members of the preforming punch and die pairs and individual members of the coining punch and die pairs can be configured to form a plurality of radial tactile portions in the steel sheet extending radially away from each of the truncated domes. In further embodiments, a third combination of individual members of the preforming punch and die pairs and individual members of the coining punch and die pairs can be configured to form field tactile portions, where the configurations of the field tactile portions are different than the truncated domes and radial tactile portions.

The one or more first workstations can include a plurality of first workstations and the preforming punch and die pairs can be distributed across a width and length of a first portion of the progressive die in the plurality of first workstations to distribute applied tonnage during formation of the detectable warning tile.

The one or more second workstations can include a plurality of second workstations and the coining punch and die pairs can be distributed across a width and length of a second portion of the progressive die in the plurality of second workstations to distribute applied tonnage during formation of the detectable warning tile. In further versions, the progressive die can also include a trimming tool of one of the second workstations configured to trim an excess width lateral edge portion of the sheet of steel having the pilot holes therein off the sheet of steel.

The progressive die can further include a pair of pilot punches of one of the first workstations that are configured to punch pilot holes in lateral edge portions of the sheet of steel and pairs of registering punches of a plurality of the first and second workstations that are configured to register the sheet of steel by extending through the pilot holes In embodiments disclosed herein, the progressive die can further include a cutting workstation having a blade configured to cut the sheet of steel to a desired length for the detectable warning tile.

A stretching assembly for a detectable warning tile having opposing end edge portions and a plurality of tactile portions formed therein is described herein that includes a stationary clamp with first and second portions that are movable with respect to one another to clamp one of the end edge portions of the detectable warning tile therebetween and a mobile clamp with first and second portions that are movable with respect to one another to clamp the other of the end edge portions of the detectable warning tile therebetween. The assembly further includes a drive mechanism that is operably coupled to the mobile clamp to drive horizontal movement of the mobile clamp away from the stationary clamp to thereby stretch the detectable warning tile. One of the first and second portions of stationary clamp and mobile clamp include cavities that are sized to receive ones of the plurality of tactile portions formed in the end edge portions of the detectable warning tile therein.

An opposite one of the first and second portions of the stationary clamp and mobile clamp can include protrusions that are aligned with the cavities and the protrusions can have shapes generally complementary to the ones of the plurality of tactile portions

BRIEF DESCRIPTION OF THE DRAWINGS

The above needs are at least partially met through provision of the embodiments described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

A stamped steel detectable warning tile and method of forming such is described herein that overcomes the difficulties of working with steel to provide a strong, low rust, low profile tile, while also overcoming various shortcomings of tiles made of conventional materials, such as cast iron. The method of the present disclosure includes preforming structures in a steel sheet and subsequently coining the preform structures to form tactile portions that exhibit satisfactory end results. Further, the tactile portions can be formed in a staggered fashion along a press to distribute tonnage within the press and extend the lifespan of the press, as well as control a curvature of the tile due to the press operations.

Figure 1:
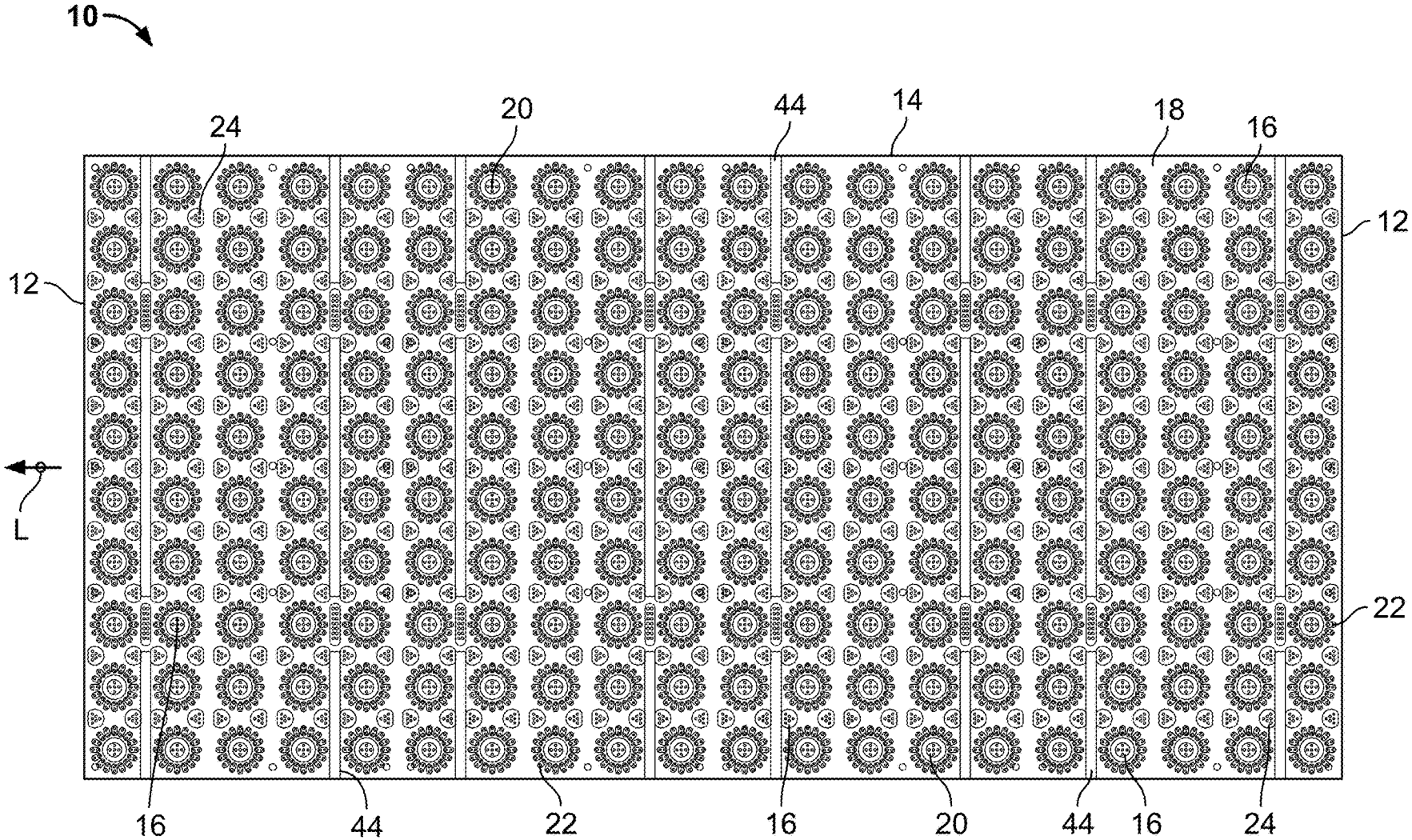
FIG. 1 is a top plan view of a detectable warning tile having an array of tactile portions in accordance with various embodiments of the present disclosure.
Figure 2:
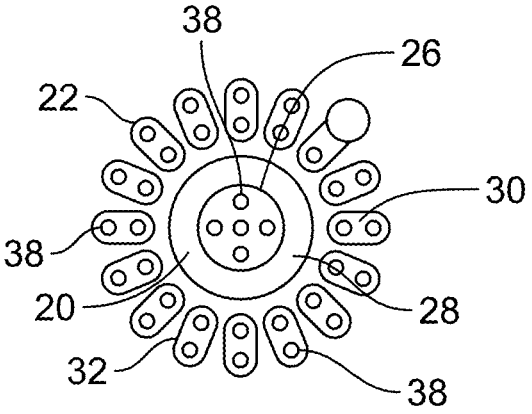
FIG. 2 is a top plan view of a daisy-shaped tactile portion of the tile of FIG. 1 showing details of a truncated dome and radial areas in accordance with various embodiments of the present disclosure, which is a single instance of a repeating daisy-shaped tactile pattern arrayed along the tile.

A formed tile 10 will first be described with reference to FIG. 1. The tile 10 includes end edges 12 and side edges 14, the side edges 14 extending parallel to a longitudinal axis L of the tile 10. As shown, the tile 10 includes an array of tactile portions 16 that are raised with respect to a general planar base 18 of the tile 10. The generally planar nature of the base 18 will be understood to include any incidental curvature or bowing that may be imparted to the tile 10 due to formation of the tactile portions 16.

The tactile portions 16 include truncated domes 20, truncated radial areas 22, and truncated field areas 24. It should be understood that the illustrated array of tactile portions 16 is only exemplary and that other configurations featuring truncated domes with associated or spaced raised portions are also within the scope of this disclosure.

The truncated domes 20 include a flat top surface 26 and a convex sidewall 28 extending between the top surface 26 and the base 18. It is recognized that the sidewall 28 may alternatively be inclined, concave, or sinusoidal in cross-section, though a shape that promotes the flow of water off the tops of the truncated domes 20, so as to avoid ice forming on the tops of the truncated domes 20 when the detectable warning tile is used in locations that experience adverse winter weather conditions, is preferred. The radial areas 22 extend radially away from each of the truncated domes 20 and include a flat top surface 30 and a convex sidewall 32 extending between the top surface 30 and the base 18. The radial areas 22 have an elongate oval or track-shaped footprint that allows the radial areas 22 to extend away from the dome 20 and provide tactile portions 16 at a variety of angles with respect thereto. As such, this shape may provide increased traction as compared to tactile circular or linearly aligned tactile portions alone. The illustrated embodiment includes sixteen of the radial areas 22, but other concentrations of radial areas 22 can alternatively be utilized. To provide further tactile areas, the field areas 24 are disposed between four adjacent daisy-shaped arrays of the truncated dome and radial areas 20, 22. Each of the field areas 24 includes a flat top surface 34 and a convex sidewall 36 extending between the top surface 34 and the base 18. The field areas 24 can take any suitable shape, such as a truncated dome footprint as shown.

Additionally, each tactile portion 16 can include one or more nubs or nibs 38 that project outwardly away from flat top surfaces 26, 30, 34 thereof. For example, each truncated dome 20 can include five nibs 38 arranged in a cross configuration, each radial area 22 can include two nibs 38 arranged along the length thereof, and each field area 24 can include five nibs 38 arranged in a trapezoid or six dimples arranged in a triangle.

Each of the field areas 24 can have witness profiles on edges 40 thereof between the top surface 26, 30, 34 and the sidewalls 28, 32, 36, and edges 42 between the sidewalls 28, 32, 36 and the base 18. As discussed in more detail below, witness profiles are formed by a coining operation.

In the illustrated form, the tactile portions 16 have a repeating pattern. For example, the tile 10 has a width of 2 feet. Accordingly, the pattern can extend across the 2 foot width and repeat along the longitudinal axis of the tile 10 every 2 feet depending on a desired length. Of course, other dimensions for the repeating pattern can be utilized, such as 6 inches, 1 foot, or 3 feet.

For some uses, it might be helpful for the end edges 12 and side edges 14 of the tile 10 to have a chamfered, curved, or otherwise blunted profile. For example, a chamfered edge 12, 14 might deflect an object striking the tile 10 from the side. The chamfered edge 12, 14 can be created by stamping, cutting, grinding, or other suitable processes. In a preferred approach, the side edges 14 can be pre-chamfered prior to the formation process for the tile 10.

While processing the tile 10, as set forth below, the tile 10 can develop a bow or curve as a result of the stamping. By one approach, the tile 10 can include an optional leveling rib or recess 44 that extends along a longitudinal or transverse axis that counters the bow in the tile 10.

It has been found that utilizing only a single coining strike to create one of the tactile portions 16 in its final form may provide unsatisfactory results. A single coining strike can include flattening, compressing, and forming the metal to create the desired shape. Unfortunately, the shaping and height required to form satisfactory tactile portions can fracture the metal and/or produce sidewalls 28, 32, 36 that are less-desirably shaped, such as concave, or, in some instances, linear. Such configurations may cause shearing strikes to impact and damage the tactile portions 16 rather than deflecting off the sidewalls 28, 32, 36. Further, in some cases, there may not be enough material to form the nibs 38 in the top surfaces 26, 30, 34 of the tactile portions 16 with one coining strike causing the nibs 38 to be unsatisfactorily undefined or shallow.

To address these issues, the process described herein includes preforming the tactile portions 16, which first raises and/or bends the metal, as opposed to the flattening, compressing, and/or forming operations performed during coining strikes. As such, the preformed metal has a generally constant thickness, e.g., between 0 and 20 percent of the material thickness, preferably between 0 and 15 percent of the material thickness, and more preferably between 0 and 10 percent of the material thickness, throughout the portions intended to ultimately become the tactile portions 16 subsequent to the preform operation, i.e., once the preformed operations are further subjected to a downstream, finishing coining strike. Moreover, this process advantageously allows the finishing coining strikes for the tactile portions 16 to have a lower forming tonnage as compared to a single coining strike.

Figure 3:
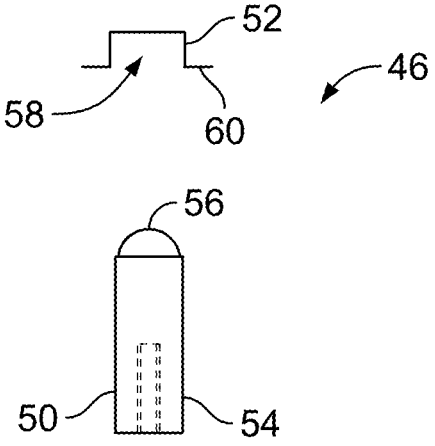
FIG. 3 is a side cross-sectional view of a punch and die for creating a preform structure in a steel sheet in accordance with various embodiments of the present disclosure.
Figure 4:
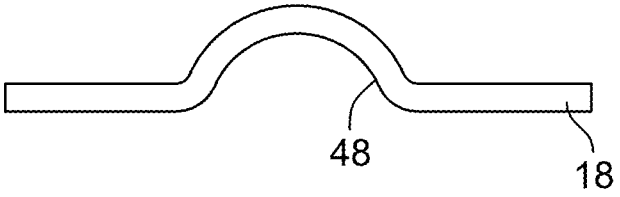
FIG. 4 is a side cross-sectional view of a preform structure for subsequently forming a truncated dome tactile portion (i.e., a portion of a sheet of steel that has been exposed to the preform punch and die of FIG. 3 to impart a dome shape to the portion of the tile, which portion of the tile is subsequently processed by coining to reshape the dome into a truncated dome), in accordance with various embodiments of the present disclosure.

Details of the truncated domes 20 and for the formation thereof are shown in FIGS. 2-6. An example preform punch and die pair 46 for a press, discussed in more detail below, configured to create a dome-shaped preform structure 48 in the tile 10 and the resulting dome-shaped preform structure 48 are shown in FIGS. 3 and 4. For the preform operation, the punch-and-die pair 46 includes a preform punch 50 configured to press a portion of the steel of the tile 10 into a preform die 52. The preform punch 50 has a preform shaft 54 extending to a rounded distal end 56. The die 52 includes a recess 58 sized to receive the rounded distal end 56 therein. Circumferences of the preform shaft 54 and die recess 58 are sized so that there is sufficient clearance for the steel of the tile 10 to raise and bend without flattening or compressing the steel. Similarly, a radius and depth of the rounded distal end 56 and a depth of the die recess 58 provide a clearance for the steel to be raised therein. Due to these clearances, the punch 50 and die 52 cooperate to bend the steel rather than coin the steel. The die recess 58 can further include a curved edge or edges 60 extending therearound configured so that the steel can bend over the curved edge 60 rather than over a sharp corner.

In the illustrated form, the preform shaft 54 preferably has a diameter of about 0.7 inches and a length of about 2 inches. The rounded distal end 56 has a curvature with a radius of about 0.35 inches and a depth of about 0.3 inches. The die recess 58 preferably has a diameter of about 0.84 inches and a depth greater than the punch rounded end 56. The edge 60 of the recess 58 preferably has a radius of curvature of about 0.075 inches.

An example of a domed region of the steel of the tile 10 after preforming is illustrated in FIG. 4. As illustrated, the dome-shaped preform structure 48 has a curved dome profile with a generally constant thickness. In the illustrated example, the dome-shaped preform structure 126, 132, 140, 150 preferably has a diameter of about 0.93 inches and a depth of about 0.26 inches.

Figure 5:
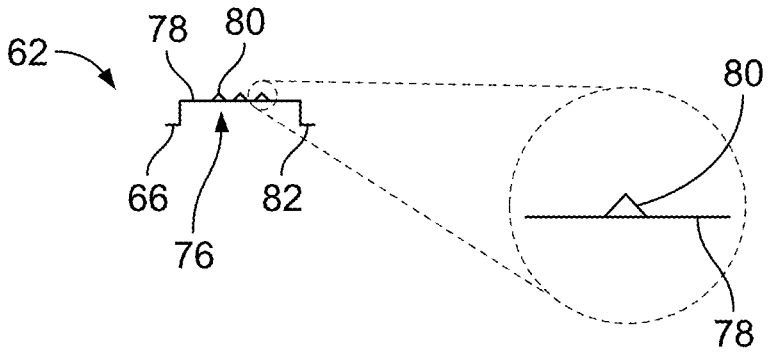
FIG. 5 is a side cross-sectional view of a punch and die for creating a final, coined structure in a steel sheet in accordance with various embodiments of the present disclosure.
Figure 5:
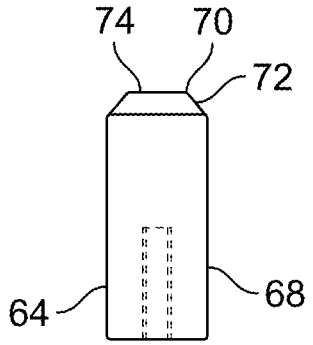

An example coining punch and die pair 62 for a press to create one of the final, truncated domes 20 in the tile 10 is illustrated in FIG. 5. In this form, the pair 62 includes a coining punch 64 and a die 66 that coins the steel into a desired final form. As such, the punch 64 includes a coining shaft 68 and a distal end 70 with an angled surface 72 and a flat end surface 74. The die 66 includes a recess 76 sized to receive the coining punch 64 therein. An end surface 78 of the recess 76 includes dimples 80 or the like arrayed thereacross corresponding to desired locations of the nibs 38 on the tactile portion 16. The die recess 76 can further include a curved edge or edges 82 extending therearound configured so that the steel can bend over the curved edge 82 rather than over a sharp corner. So configured, the steel is pressed into the die recess 76 with sufficient force that steel is forced into the dimples 80 to form the nibs 38 while also flattening the dome top surface 26, and forming the concave sidewall 28 while also creating the witness profile edges 40, 42.

In the illustrated embodiment, the shaft 68 has a diameter of about 0.875 inches and a length of about 2 inches. The distal end 70 has a depth of about 0.21 inches where the angled surface 72 extends at an angle of about 47 degrees. The flat end surface 74 of the distal end 70 has a diameter of about 0.48 inches. The die recess 76 has a diameter of about 0.95 inches and a depth of about 0.2 inches. The edge 82 of the recess 76 has a radius of curvature of about 0.03 inches. The dimples 80 are conical in shape with a bottom diameter of about 0.09 inches, a depth of about 0.045 inches, and a sidewall angle of about 90 degrees.

Figure 6:
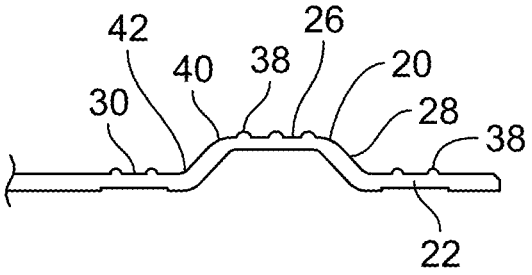
FIG. 6 is a side cross-sectional view of a final, coined truncated dome tactile portion of what was previously the preform structure of FIG. 4, in accordance with various embodiments of the present disclosure.

An example of a truncated dome region of the steel of the tile 10 after the coining operation is illustrated in FIG. 6. As illustrated, the final truncated dome 20 has the flat top surface 26, the concave sidewall 28, and the nibs 38 with the edges 40, 42 therebetween. Further, the truncated dome 20 has varying thicknesses throughout, as compared to the constant-thickness preform dome structure 48 (as can be appreciated by comparing FIGS. 4 and 6 to one another). For example, as shown in FIG. 6, the nibs 38 can have a first thickness, the top wall 26 can have a second thickness greater than the first thickness, and the sidewall 28 can have a third thickness greater than the first and second thicknesses. In the illustrated form, the final dome 20 has a diameter of about 0.84 inches and a depth of about 0.2 inches, where the top surface 26 has a thickness of about 0.04 inches. The nibs 38 have a depth of about 0.024 inches. Two radial areas 22 are also shown on either side of the dome 20.

Figure 7:
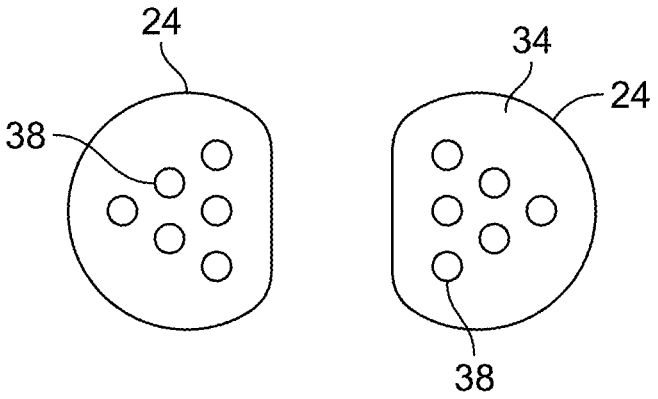
FIG. 7 is a top plan view of a field area tactile portion of the tile of FIG. 1 in accordance with various embodiments of the present disclosure.
Figure 8:
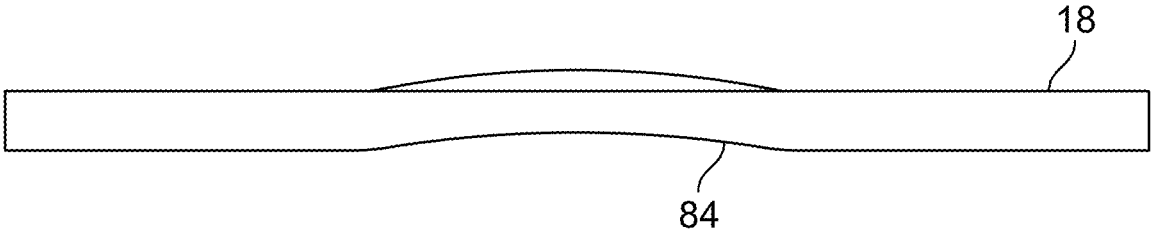
FIG. 8 is a side cross-sectional view of a preform structure for forming a field area tactile portion in accordance with various embodiments of the present disclosure.
Figure 9:
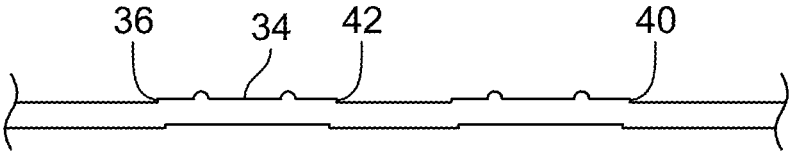
FIG. 9 is a side cross-sectional view of a final, coined structure of what was previously the preform structure of FIG. 8, in accordance with various embodiments of the present disclosure.

Additional details of the field areas 24 can be appreciated with reference to FIGS. 7-9. As illustrated, a field preform structure 84 has a curved dome profile with a generally constant thickness. The final field area 24 as shown in FIG. 9, however, has the flat top surface 30, sidewall 32, and nibs 38 with the edges 40, 42 therebetween. In the illustrated example, the field preform structure 84 preferably has a length of about 0.84 inches and a depth of about 0.047 inches, and the final field area 24 has a length of about 0.69 inches and a depth of about 0.02 inches. The nibs 38 have a depth of about 0.03 inches.

Figure 13:
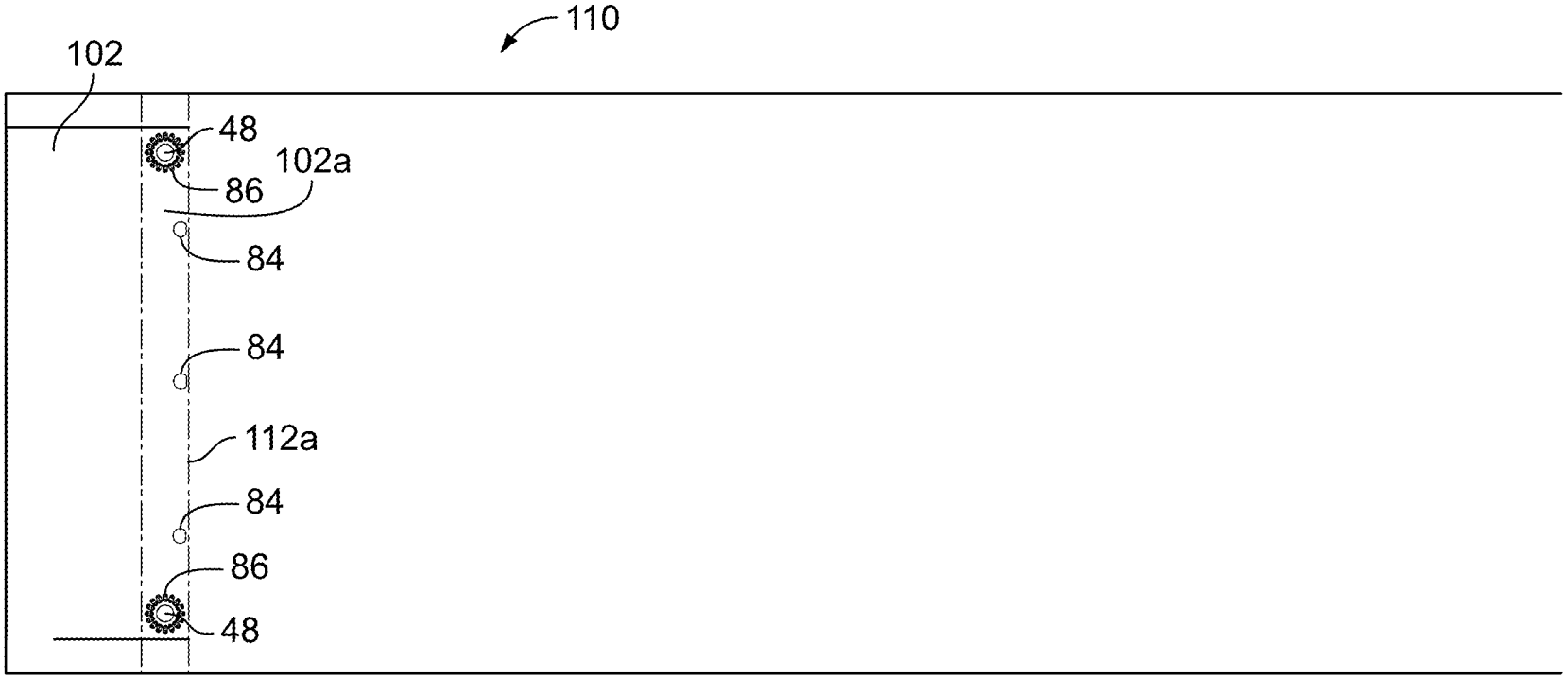
FIG. 13 is a top plan view of a first operation within a progressive die of the press of FIG. 12 in accordance with various embodiments of the present disclosure.
Figure 14:
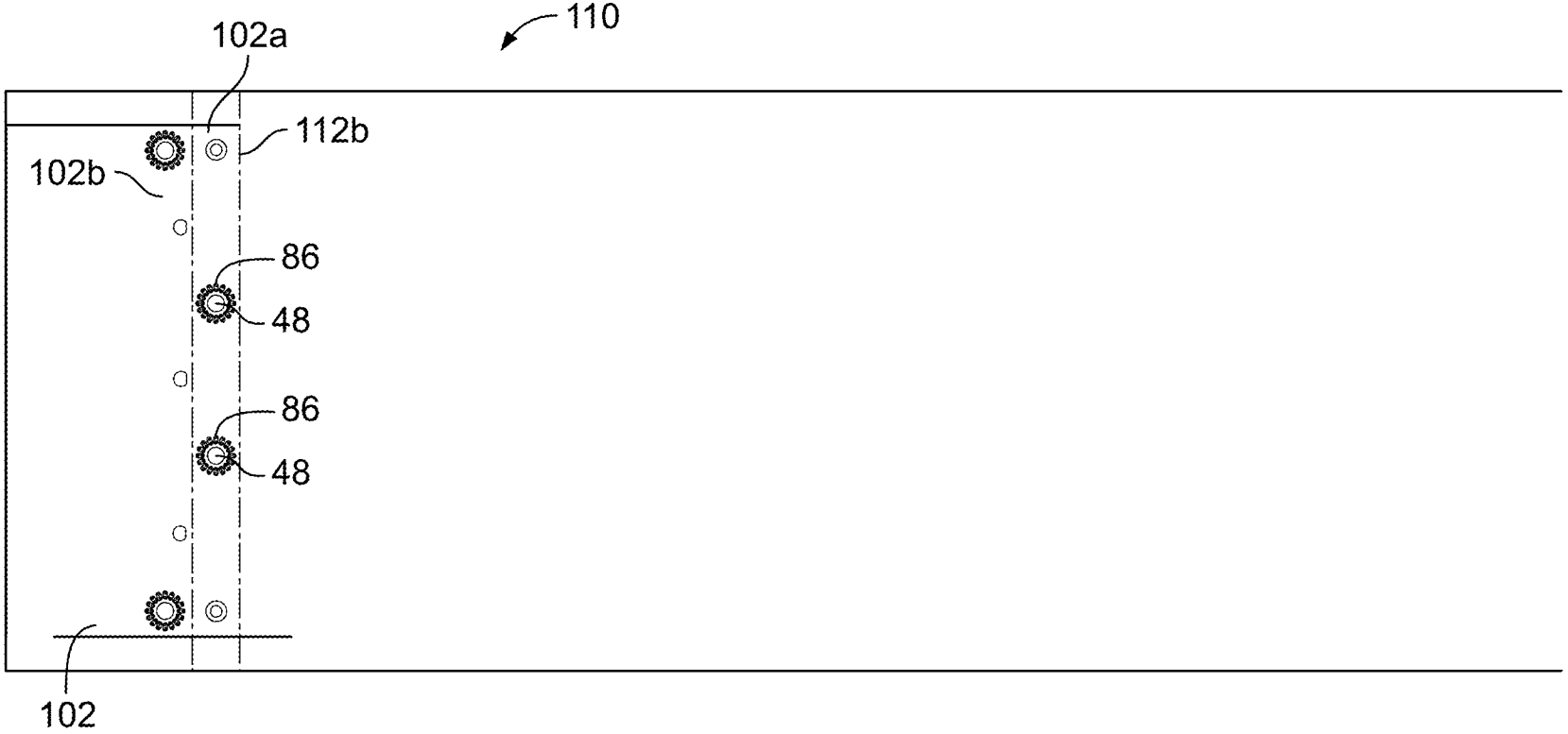
FIG. 14 is a top plan view of a second operation within the progressive die of the press of FIG. 12 in accordance with various embodiments of the present disclosure.
Figure 15:
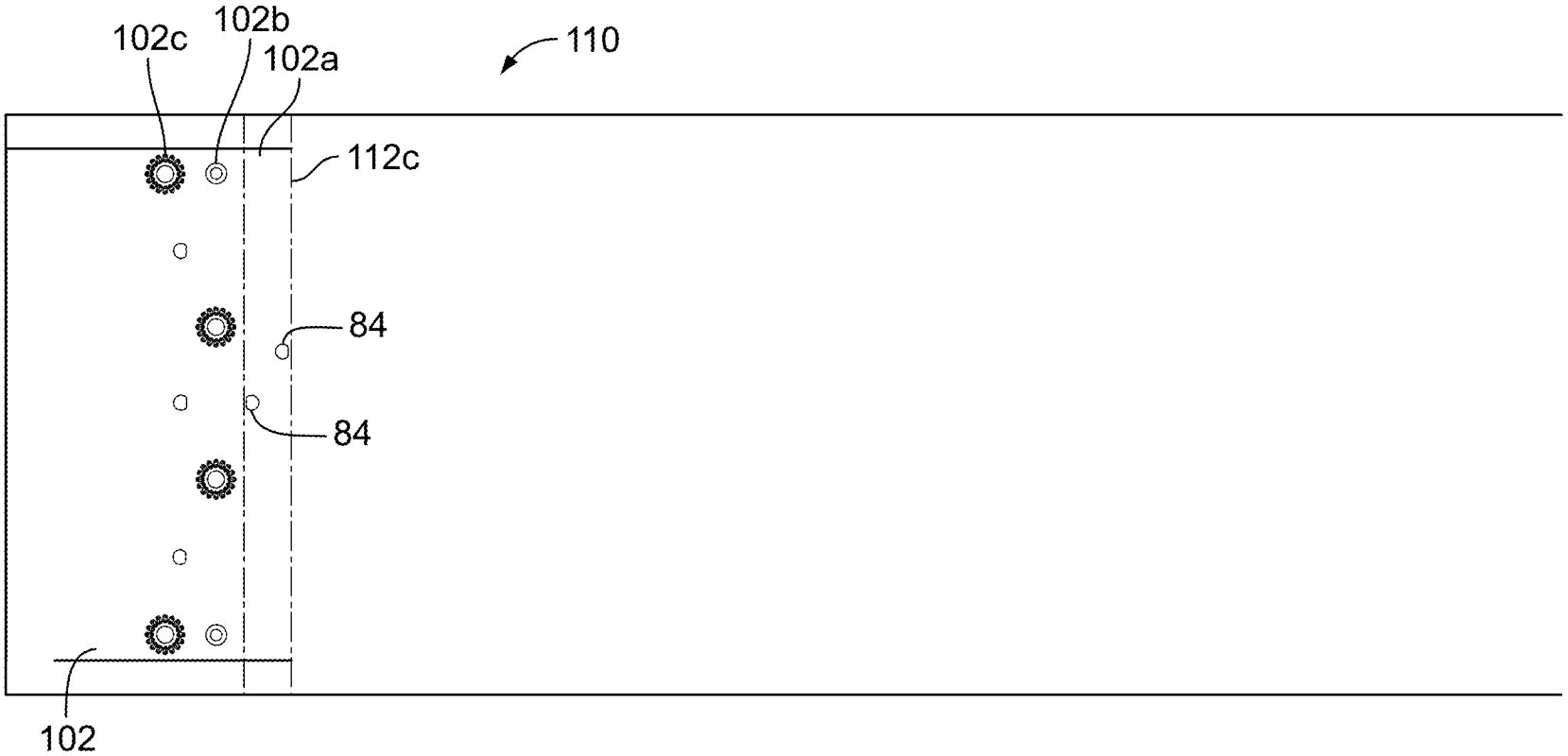
FIG. 15 is a top plan view of a third operation within the progressive die of the press of FIG. 12 in accordance with various embodiments of the present disclosure.
Figure 16:
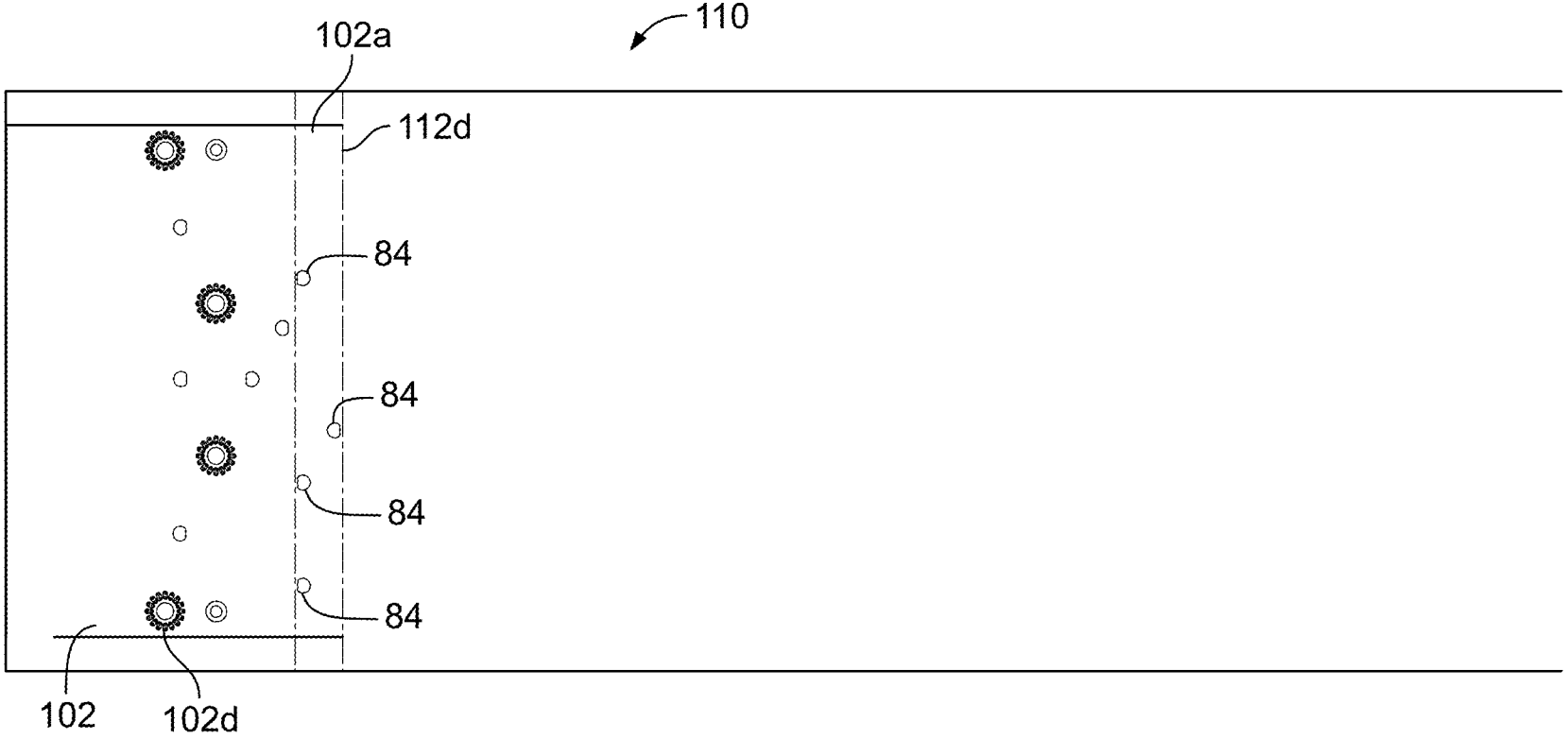
FIG. 16 is a top plan view of a fourth operation within the progressive die of the press of FIG. 12 in accordance with various embodiments of the present disclosure.
Figure 17:
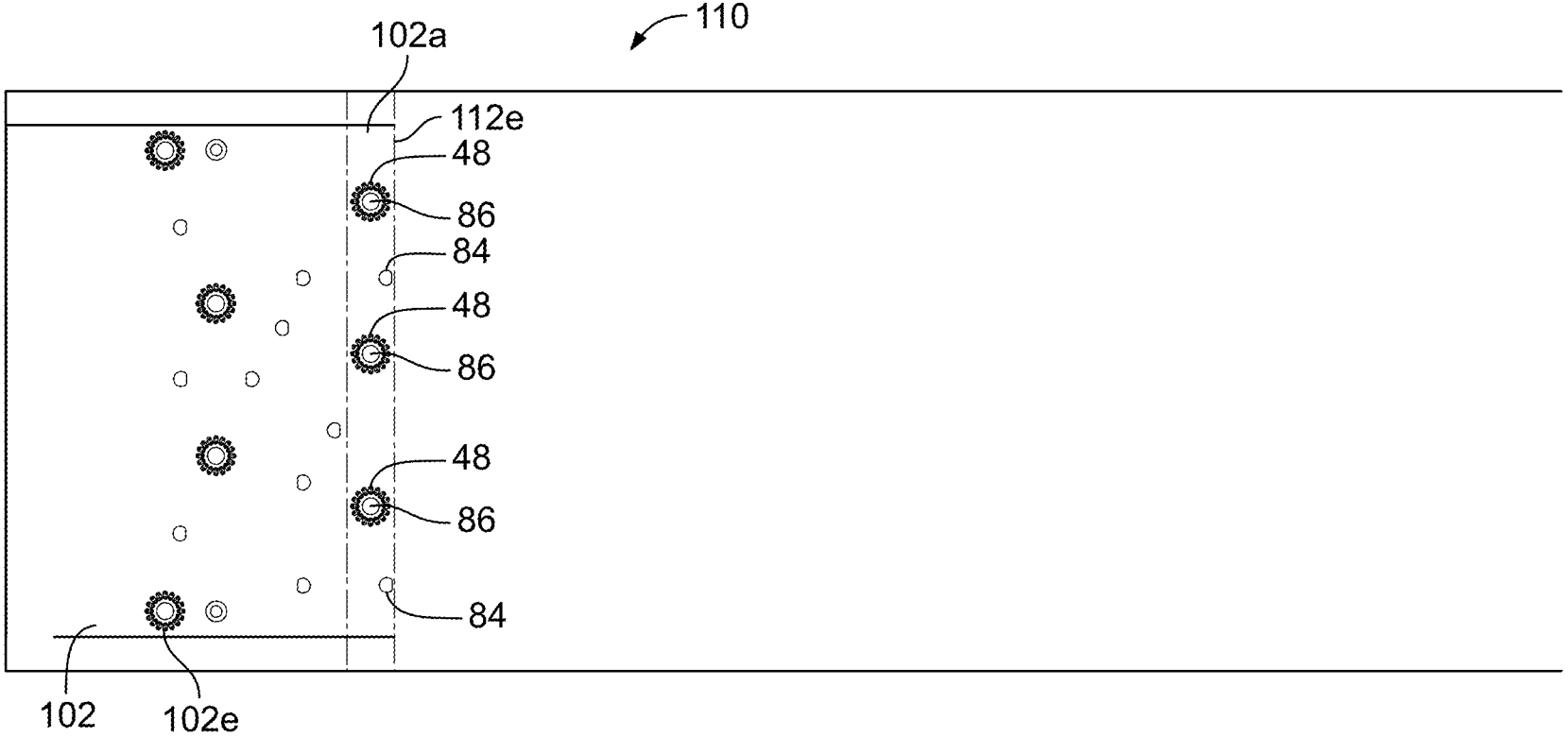
FIG. 17 is a top plan view of a fifth operation within the progressive die of the press of FIG. 12 in accordance with various embodiments of the present disclosure.
Figure 18:
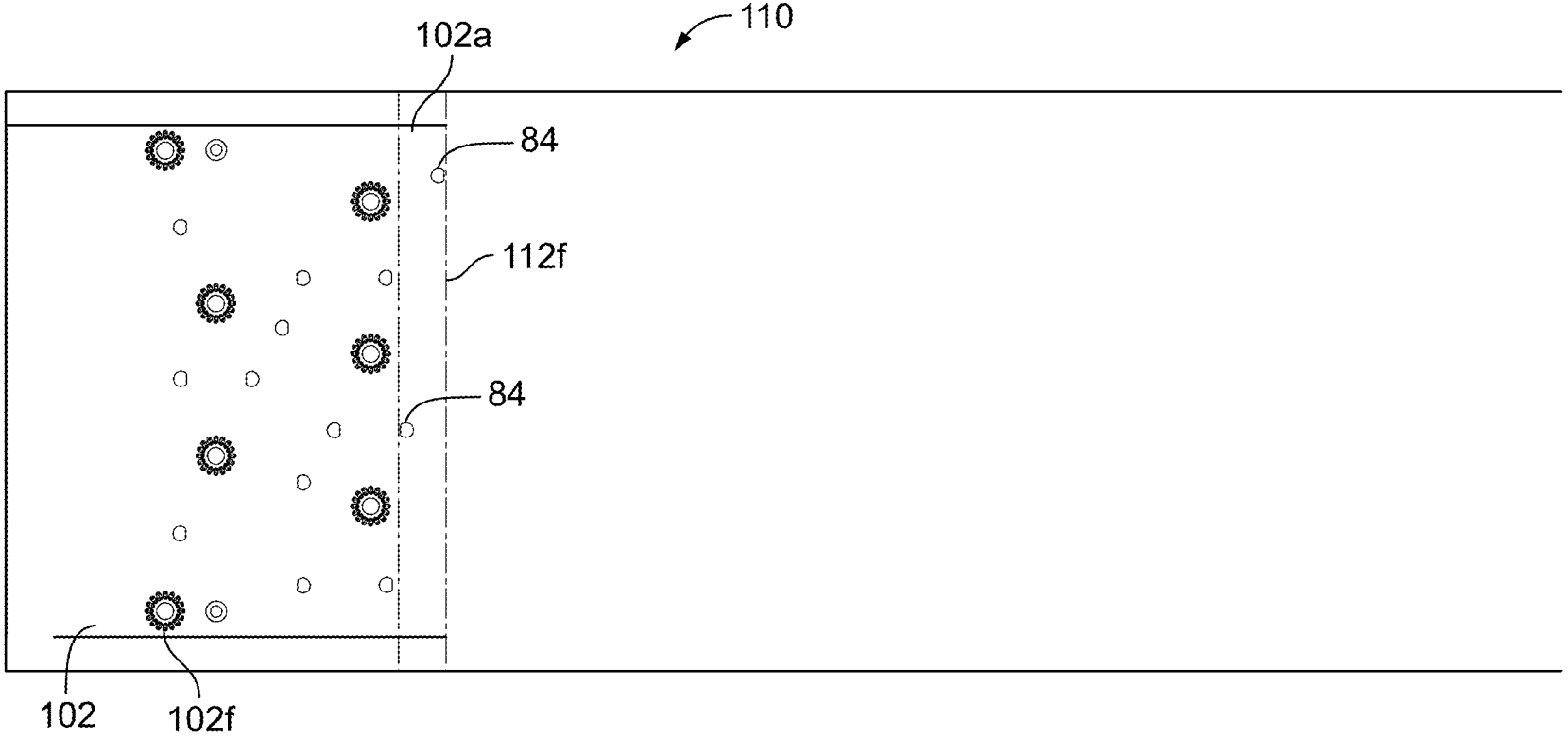
FIG. 18 is a top plan view of a sixth operation within the progressive die of the press of FIG. 12 in accordance with various embodiments of the present disclosure.
Figure 19:
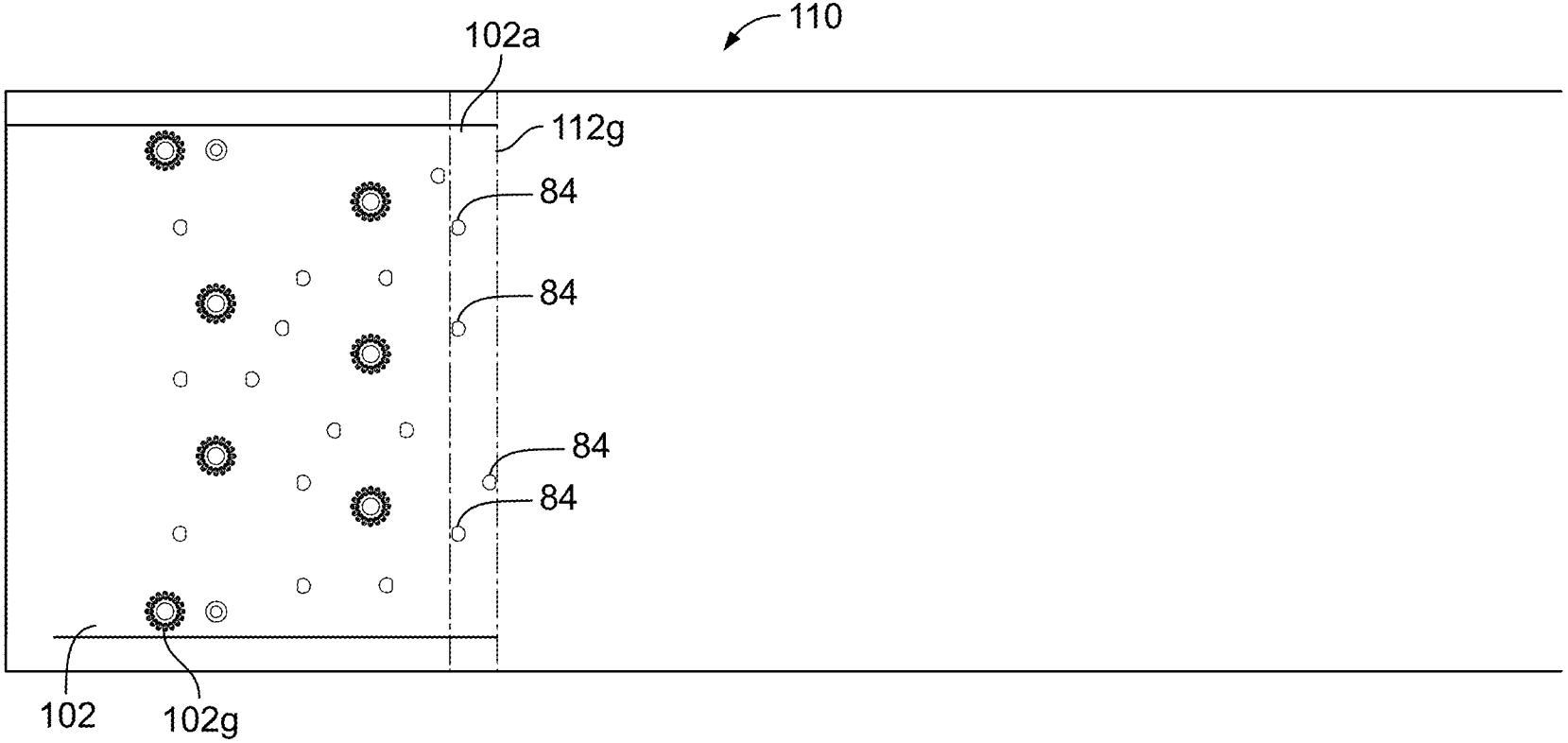
FIG. 19 is a top plan view of a seventh operation within the progressive die of the press of FIG. 12 in accordance with various embodiments of the present disclosure.
Figure 20:
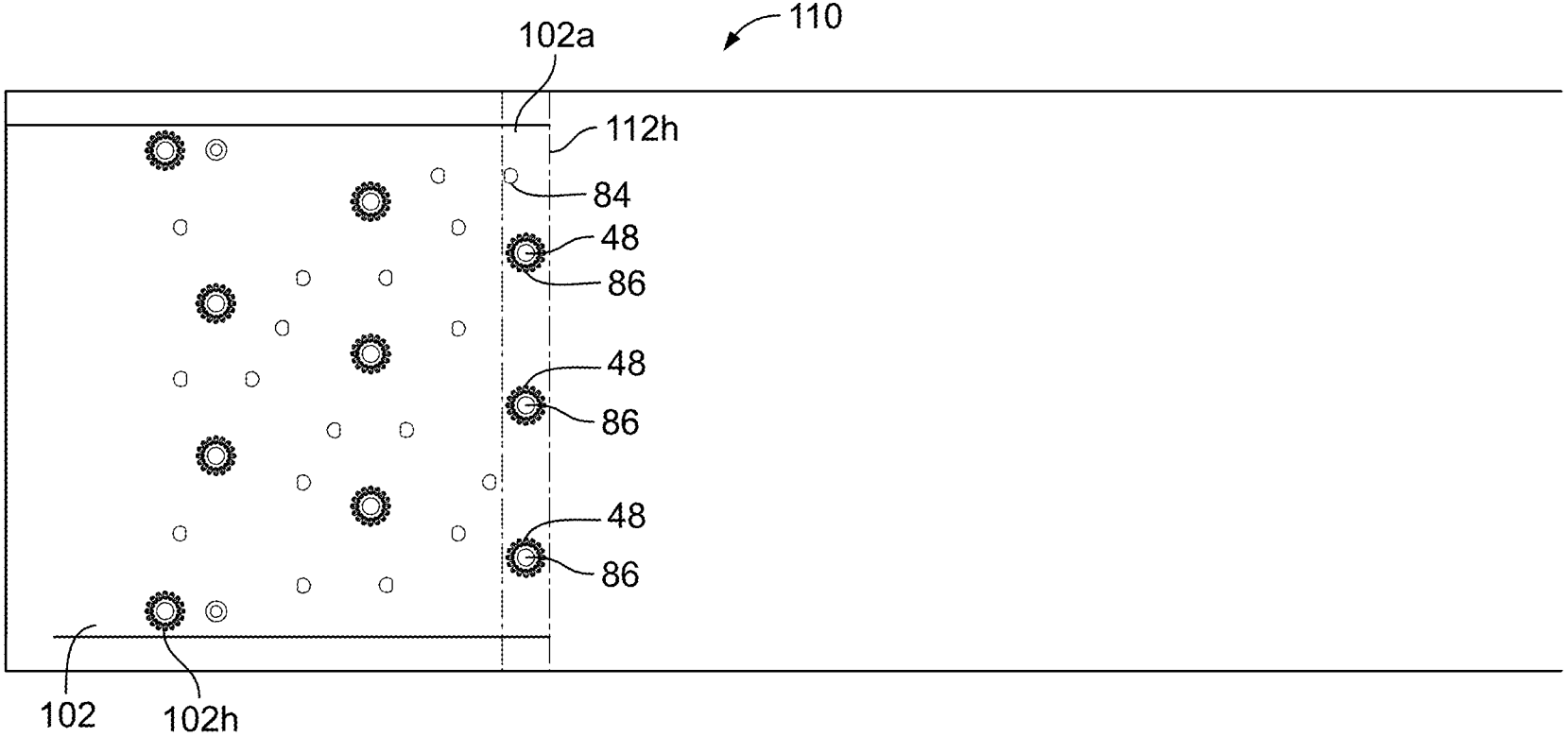
FIG. 20 is a top plan view of an eighth operation within the progressive die of the press of FIG. 12 in accordance with various embodiments of the present disclosure.

Punch and die pairs 46, 62 for the dome preform structure 48 and the final truncated domes 20 are described with reference to FIGS. 3-6. It will be understood that punch and die pairs configured in a similar manner are utilized to form radial preform structures 86 (e.g., FIG. 13), the field area preform structures 84, the radial areas 22, and the field areas 24. Further, punch and die pairs configured to create tactile portions of other shapes and sizes are within the scope of this disclosure.

Figure 10:
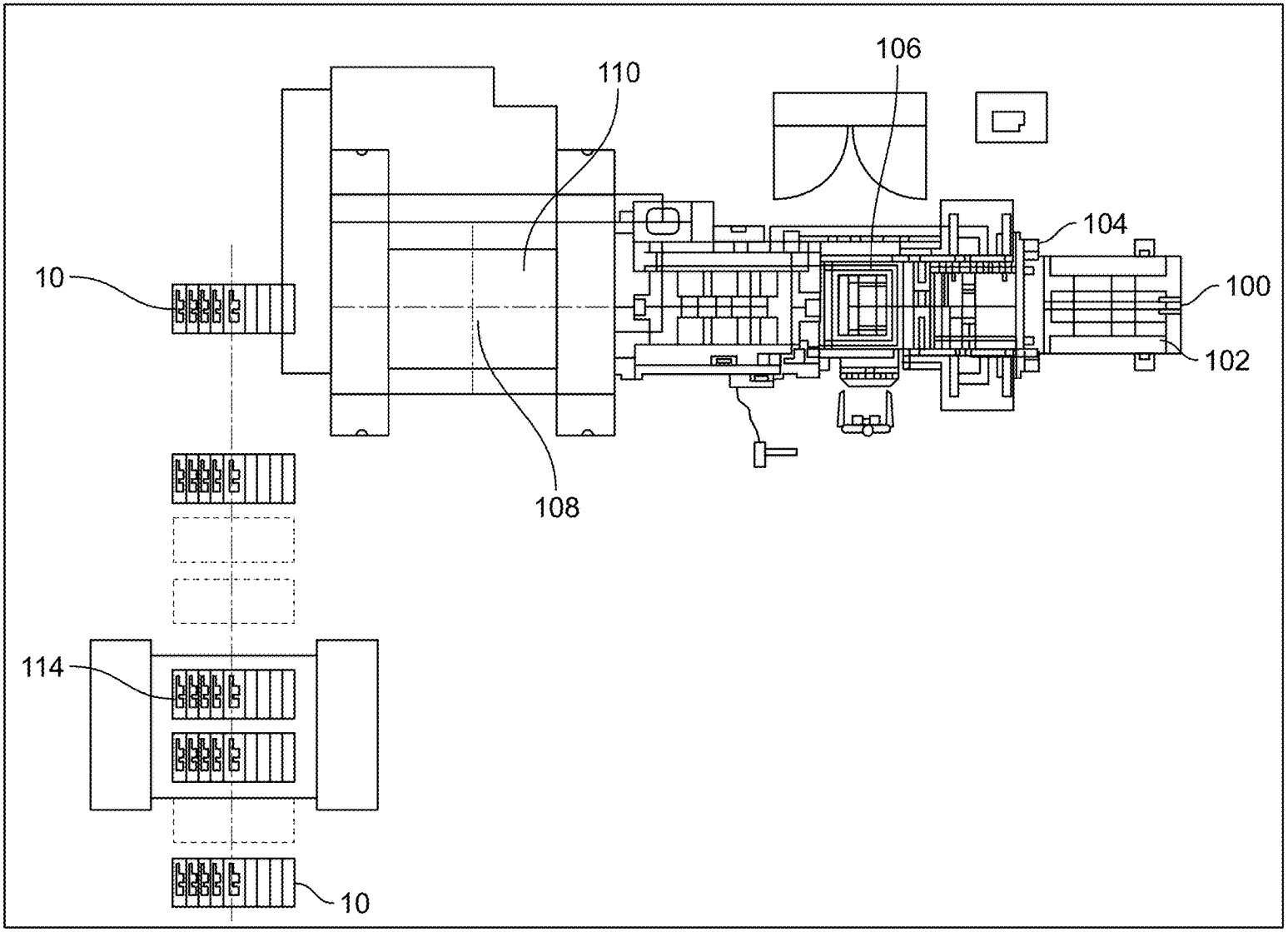
FIG. 10 is a top diagrammatic view of a system layout for creating a tile having an array of tactile portions in accordance with various embodiments of the present disclosure.

A suitable process and system configuration for creating the tile 10 is illustrated schematically in FIG. 10. The process begins with a coil or roll 100 of a suitable steel 102, described in more detail below. The steel 102 is advanced off of the coil 100 using a feeding mechanism 104. The steel 102 is first flattened from a curved configuration due to the coil 100 using a suitable machine 106, such as a flattener, leveler, or straightener.

The flattened steel 102 is then fed into and through a high tonnage press 108 suitable for working with the steel 102 by the feeding mechanism 104. Advantageously, the process described herein utilizes a progressive die 110 within the press 108 that includes a series of workstations 112 distributed along the longitudinal axis of the press 108. The punch and die pairs 46 for creating the preform structures and finished tactile portions 16 are staggered along the width of the individual workstations 112 with respect to adjacent workstations 112 to thereby utilize a full width of the press 108 while also utilizing the full length of the press 108. This distributed applied tonnage extends the lifespan of the press 108.

So configured, the steel 100 is fed into and through the progressive die 110, which sequentially strikes the steel 100 as it is fed therethrough to form the preform structures 48, 84, 86 and the final tactile portions 16 and ultimately cuts the steel 100 into a tile 10 having a desired length. The tiles 10 are then transported to, and oriented within, a single strike die 114 to perform finishing operations.

Figure 11:
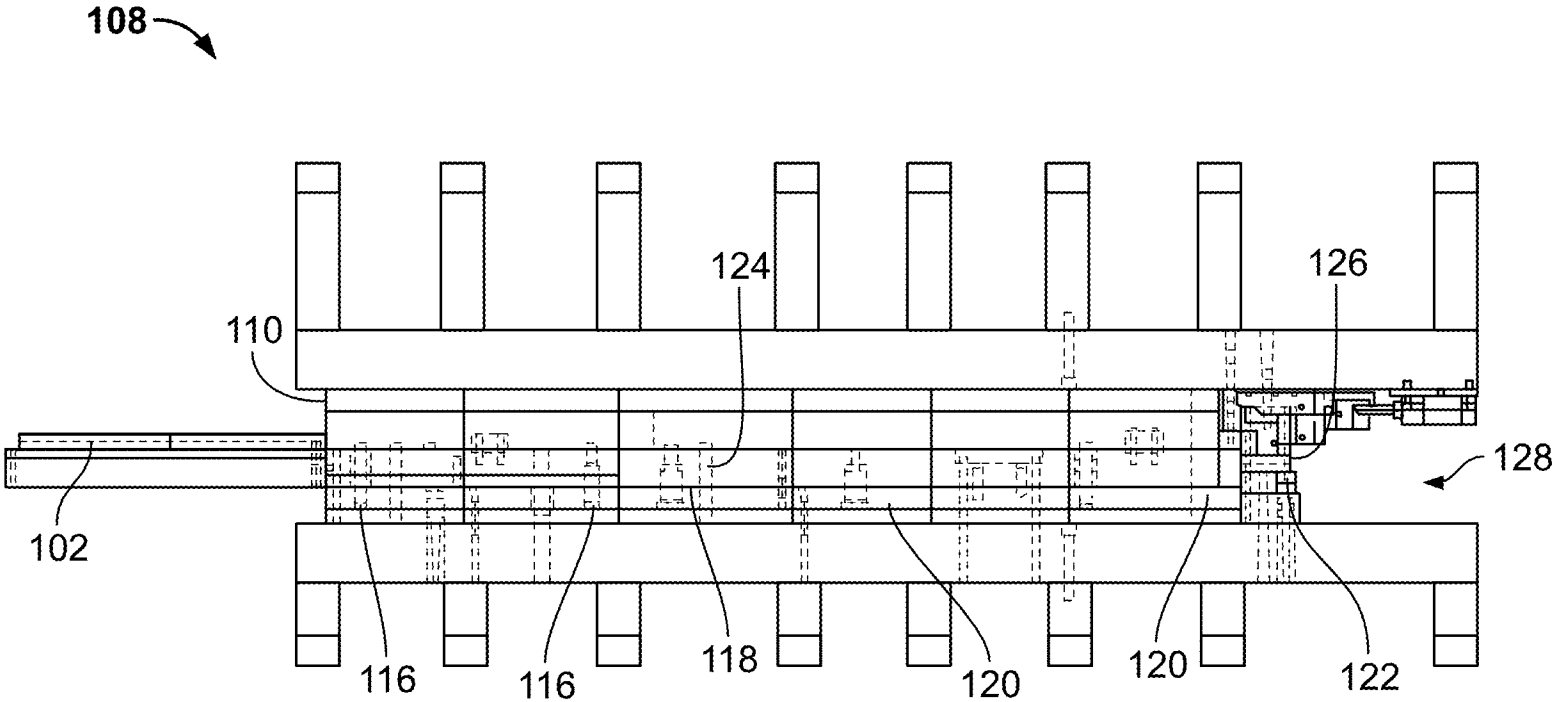
FIG. 11 is a side diagrammatic view of a first example press for the system of FIG. 10 identifying preform, leveling, restrike, and cutoff sections in accordance with various embodiments of the present disclosure.

Details of the progressive die 110, and the workstations 112 therein, will now be described with reference to FIGS. 11-38. As illustrated in FIG. 11, the progressive die 110 includes a preform section 116, a leveling section 118, a restrike section 120, and a cutting section 122. In the illustrated form, the preform section 116 includes five workstations 112 and the restrike section 120 includes five workstations 112, thereby distributing the tonnage of the press 108. The feeding mechanism 104 is configured to advance the steel sheet 102 a predetermined amount so that each portion of the sheet 102 is sequentially subjected to the operation associated with each workstation 112.

Figure 12:
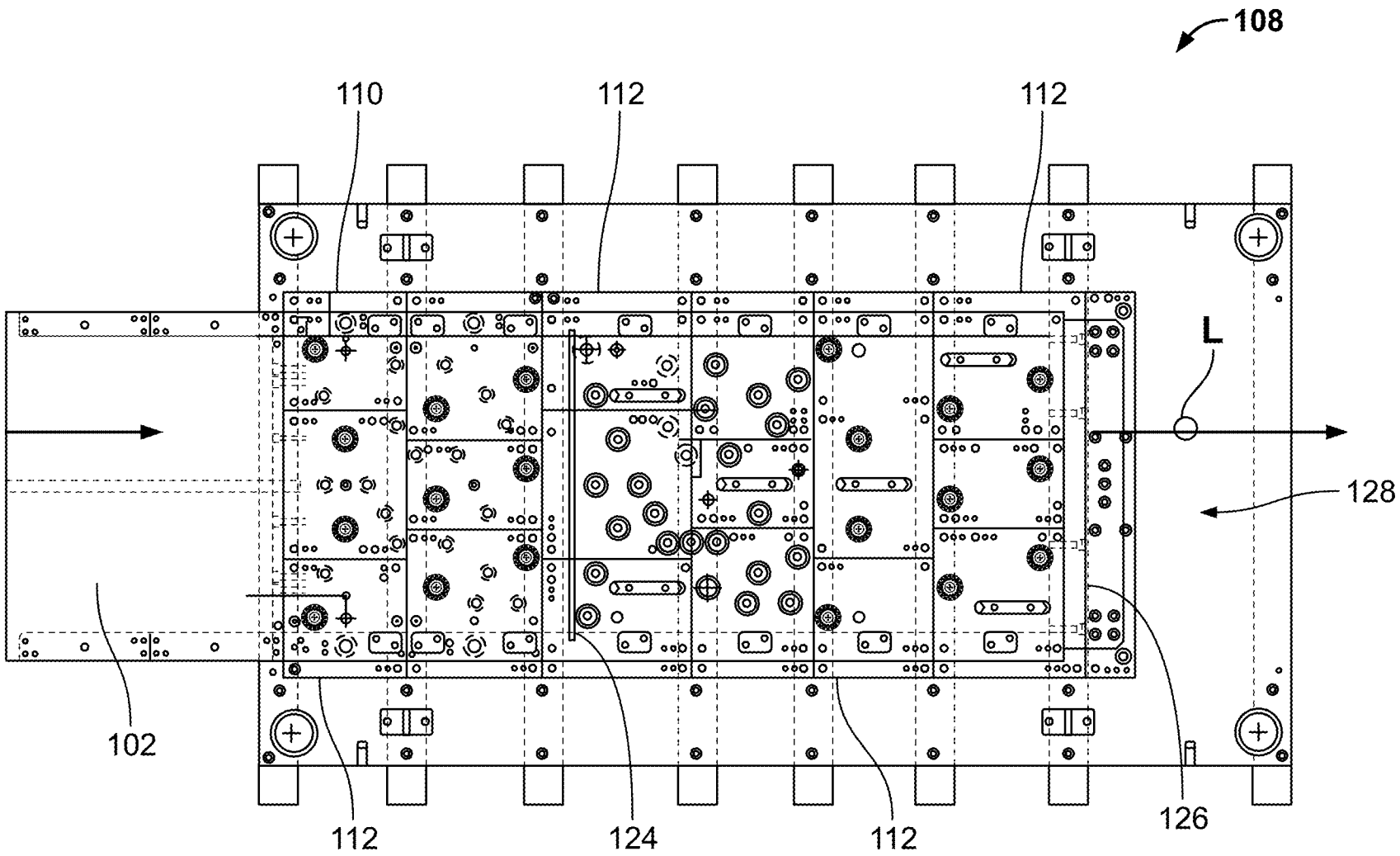
FIG. 12 is a bottom diagrammatic view of the press of FIG. 11 in accordance with various embodiments of the present disclosure.

FIG. 12 shows a bottom view of the progressive die 110 and each of the workstations 112 thereof. FIGS. 13-38 show the sequential operations of the progression of the steel sheet 102 as it is first fed through the progressive die 110. The feeding mechanism 104 advances a first portion 102*a* of the steel sheet 102 to the first workstation 112*a* and the die 110 operates to strike two dome preform structures 48, radial preform structures 86 around the dome preform structures 48, and three field preform structures 84 spaced along the width of the steel sheet 102.

After the stroke of the die 110, the feeding mechanism 104 advances the steel sheet 102 the predetermined distance, such as 2.4 inches, so that the first portion 102*a* is aligned with a second workstation 112*b* and a second portion 102*b* is aligned with the first workstation 112*a*. The die 110 then operates the second workstation 112*b* to strike two dome preform structures 48 and radial preform structures 86 around the two dome preform structures 48 in the first portion 102*a* of the steel sheet 102. Simultaneously, the die 110 operates the first workstation 112*a* to strike the two dome preform structures 48, the radial preform structures 86 around the two dome preform structures 48, and the three field preform structures 84 spaced along the width of the steel sheet 102 in the second portion 102*b* of the steel sheet 102.

Thereafter, the feeding mechanism 104 advances the steel sheet 102 the predetermined amount so that the first portion 102*a* is aligned with a third workstation 112*c*, the second portion 102*b* is aligned with the second workstation 112*b*, and a third portion 102*c* is aligned with the first workstation 112*a*. Each workstation 112 operates with each stroke of the die 104, such that with a next operation of the die 110, the second portion 102*b* is subjected to the workstation 112 previously applied to the first portion 102*a*, the third portion 102*c* is subjected to the workstation 112 previously applied to the second portion 102*b*, and so forth. Accordingly, for the sake of brevity, only the operations performed on the first portion 102*a* will be described hereafter, with the understanding that each portion of the steel sheet 102 is sequentially subjected to each workstation 112 in the progressive die 110. Once the first portion 102*a* is aligned in the third workstation 112*c*, the die 110 operates the third workstation 112*c* to strike two field preform structures 84.

The feeding mechanism 104 then advances the steel sheet 102 the predetermined amount so that the first portion 102*a* is aligned with a fourth workstation 112*d*. The die 110 operates the fourth workstation 112*d* to strike four field preform structures 84 distributed along a width of the sheet 102. After subsequent advancements, the die 110 operates a fifth workstation 112*e* to strike three dome preform structures 48, radial preform structures 86 around the three dome preform structures 48, and two field preform structures 84; a sixth workstation 112*f* to strike two field preform structures 84; a seventh workstation 112*g* to strike four field preform structures 48; and an eighth workstation 112*h* to strike three dome preform structures 48, radial preform structures 86 around the three dome preform structures 48, and a field preform structure 84. Accordingly, after the first portion 102*a* has advanced through the eighth workstation 112*h*, the die 110 has struck ten dome preform structures 48, radial preform structures 86 around the ten dome preform structures 48, and eighteen field preform structures 84 for a finished preform configuration.

Figure 21:
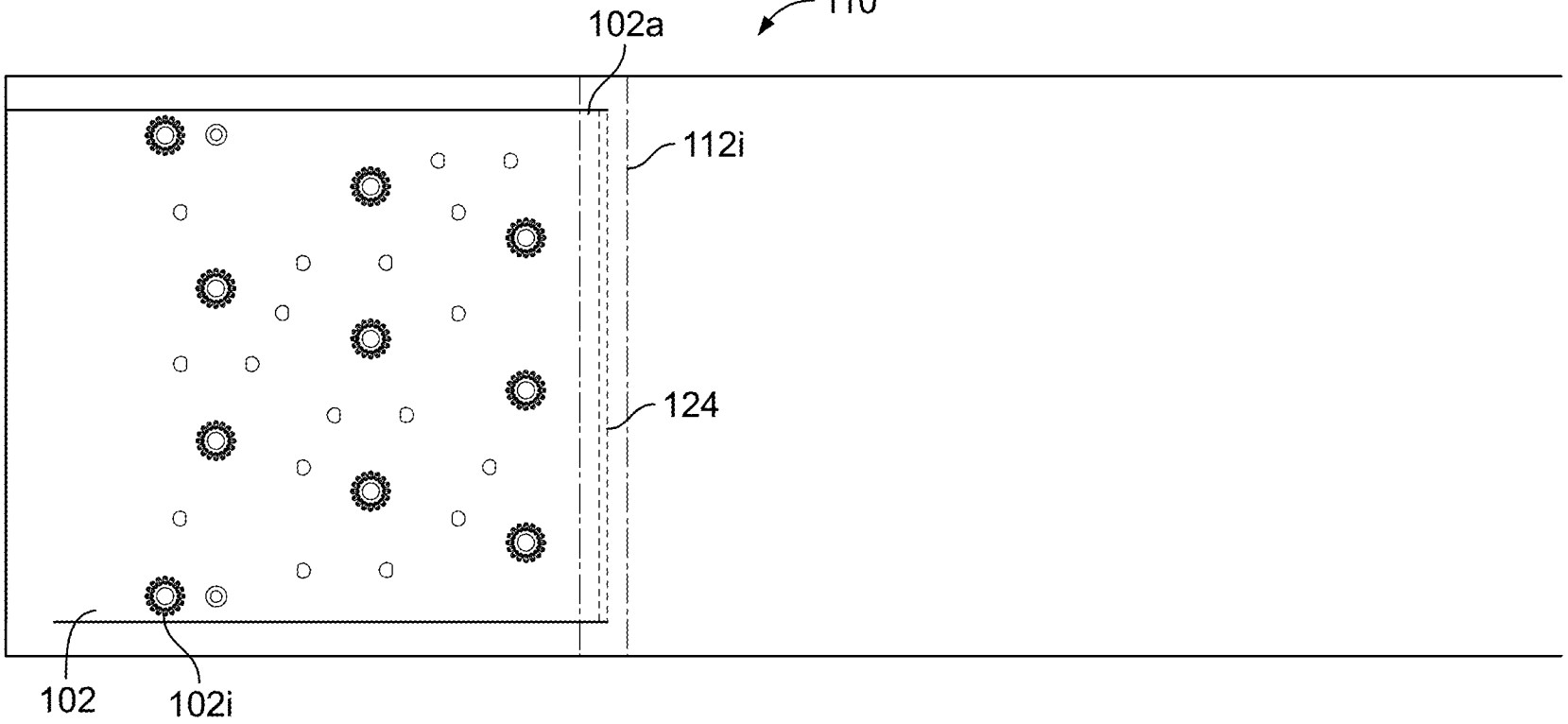
FIG. 21 is a top plan view of a ninth operation within the progressive die of the press of FIG. 12 in accordance with various embodiments of the present disclosure.
Figure 22:
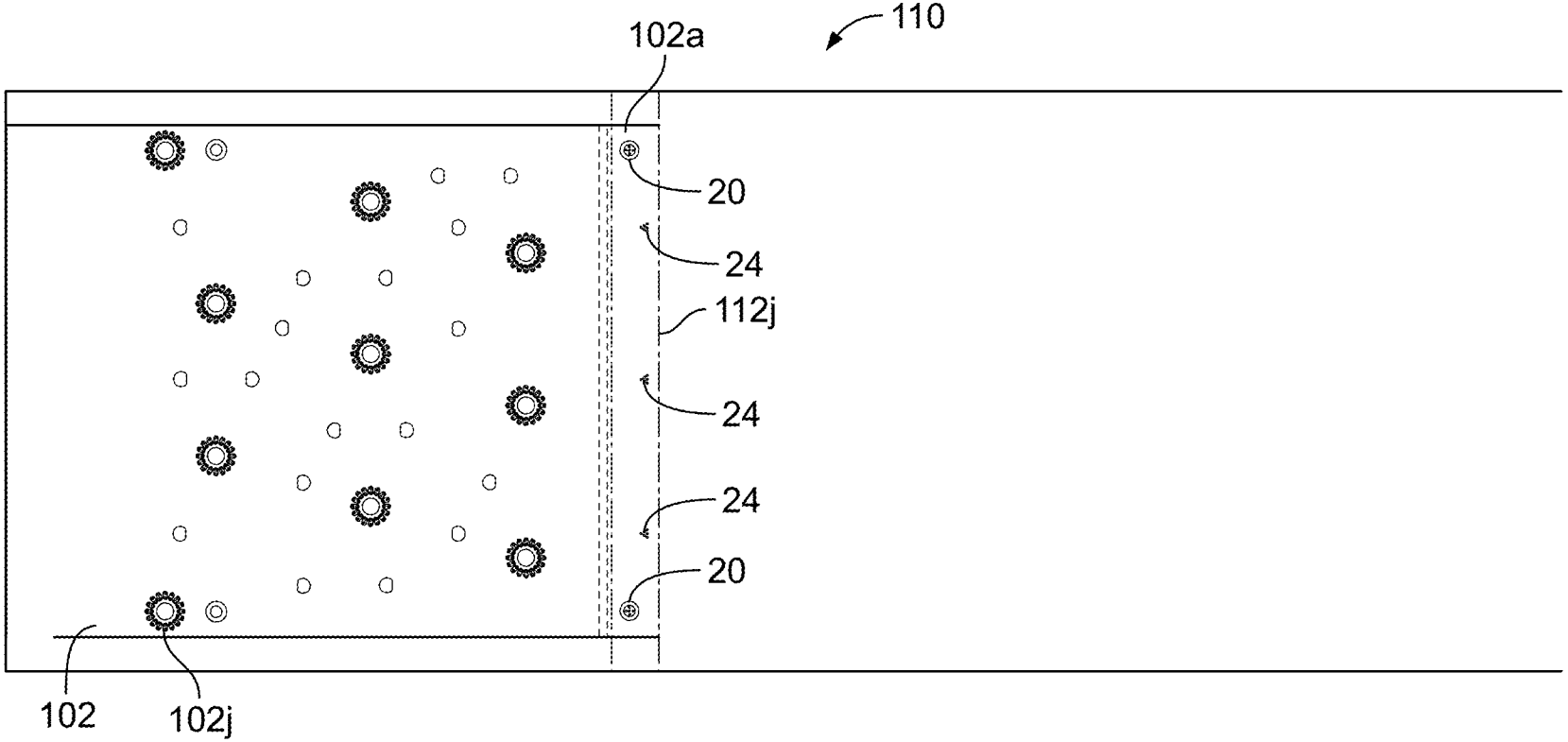
FIG. 22 is a top plan view of a tenth operation within the progressive die of the press of FIG. 12 in accordance with various embodiments of the present disclosure.
Figure 23:
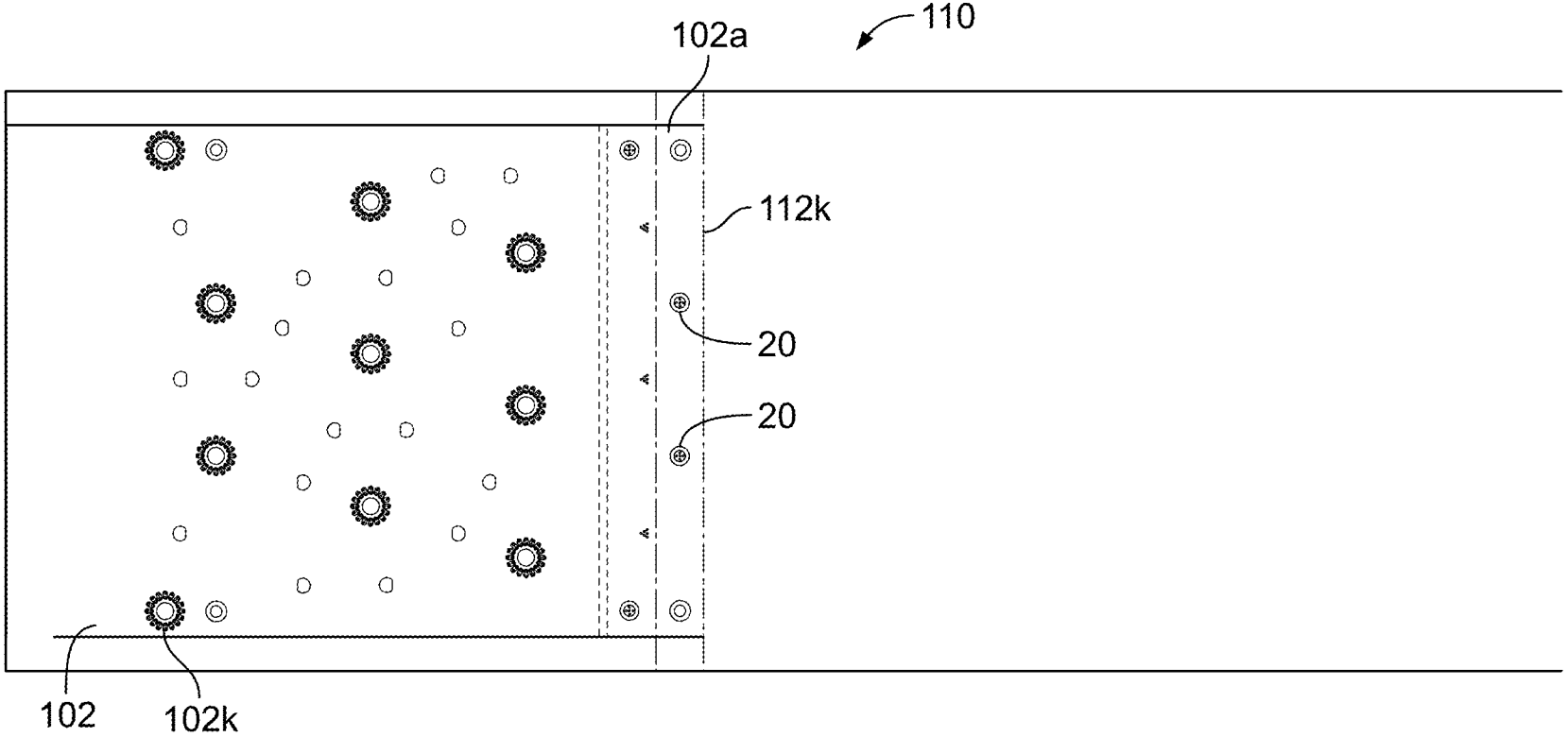
FIG. 23 is a top plan view of an eleventh operation within the progressive die of the press of FIG. 12 in accordance with various embodiments of the present disclosure.
Figure 24:
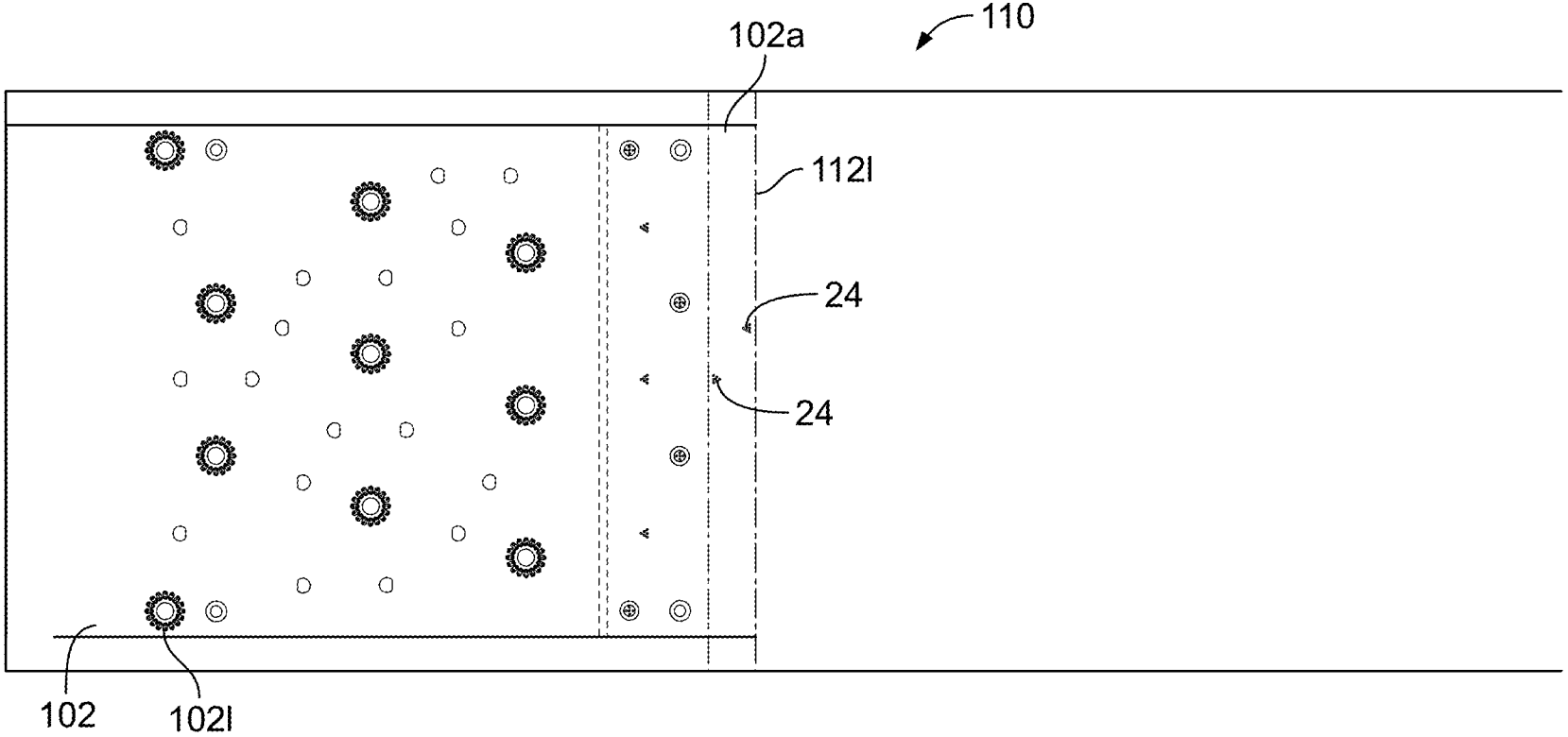
FIG. 24 is a top plan view of a twelfth operation within the progressive die of the press of FIG. 12 in accordance with various embodiments of the present disclosure.
Figure 25:
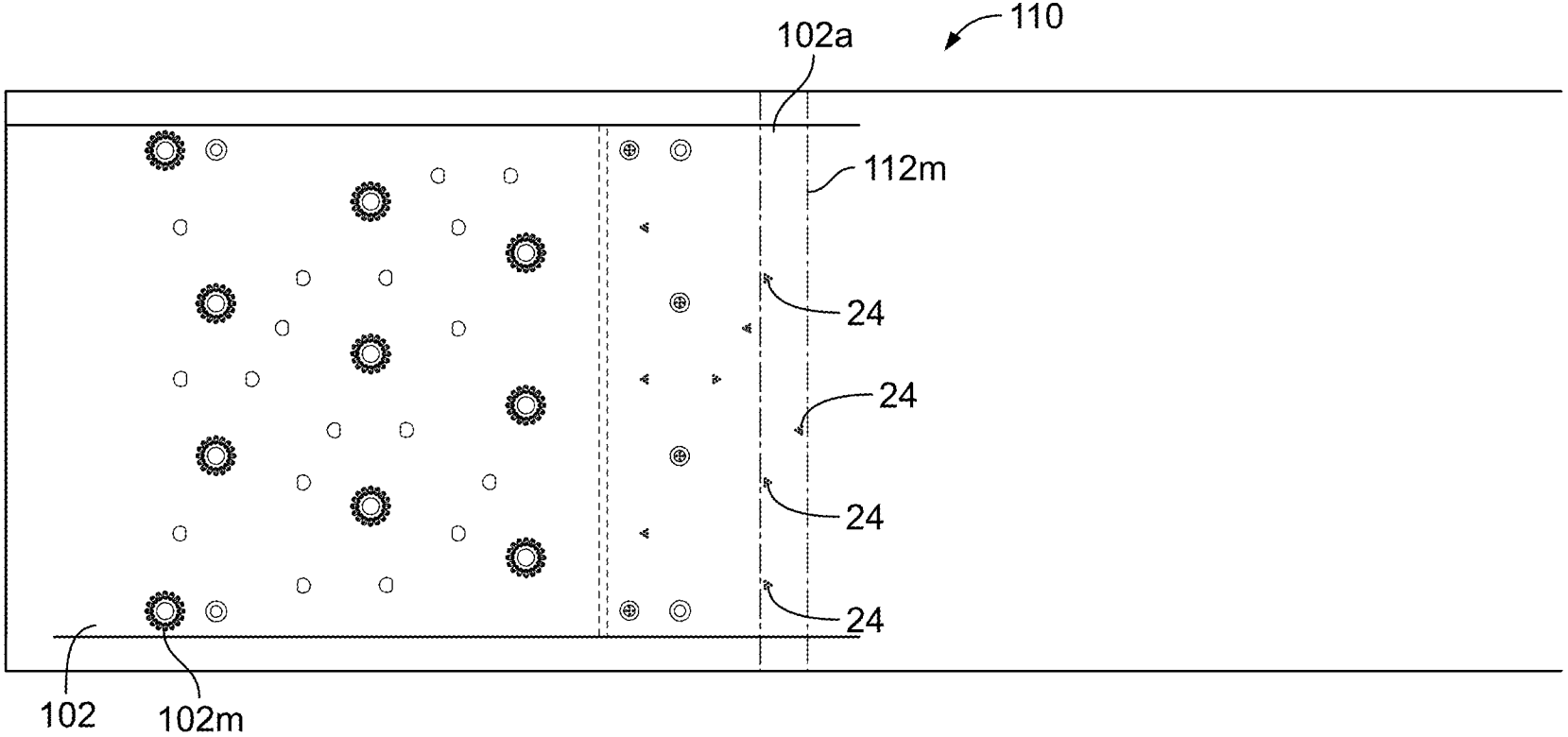
FIG. 25 is a top plan view of a thirteenth operation within the progressive die of the press of FIG. 12 in accordance with various embodiments of the present disclosure.
Figure 26:
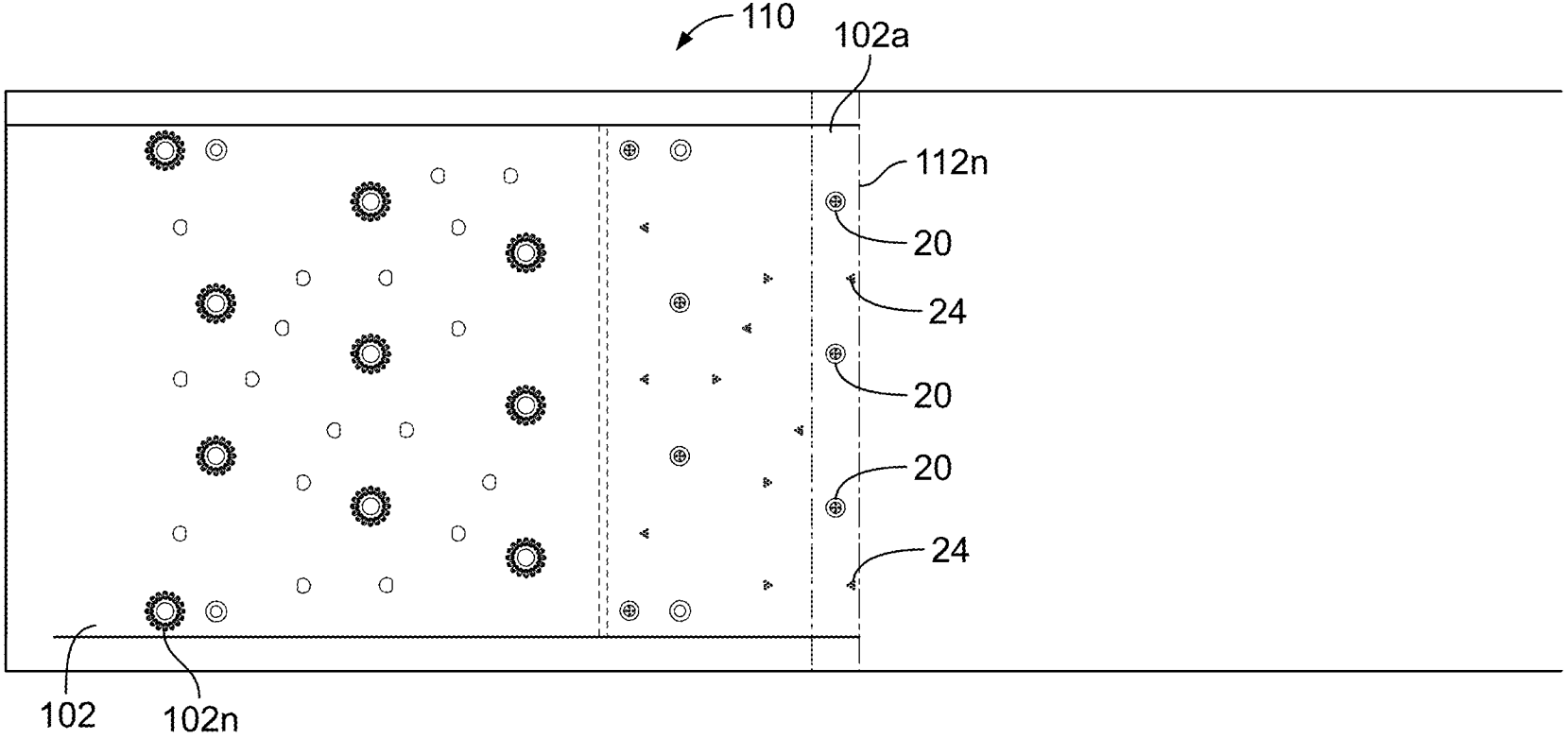
FIG. 26 is a top plan view of a fourteenth operation within the progressive die of the press of FIG. 12 in accordance with various embodiments of the present disclosure.
Figure 27:
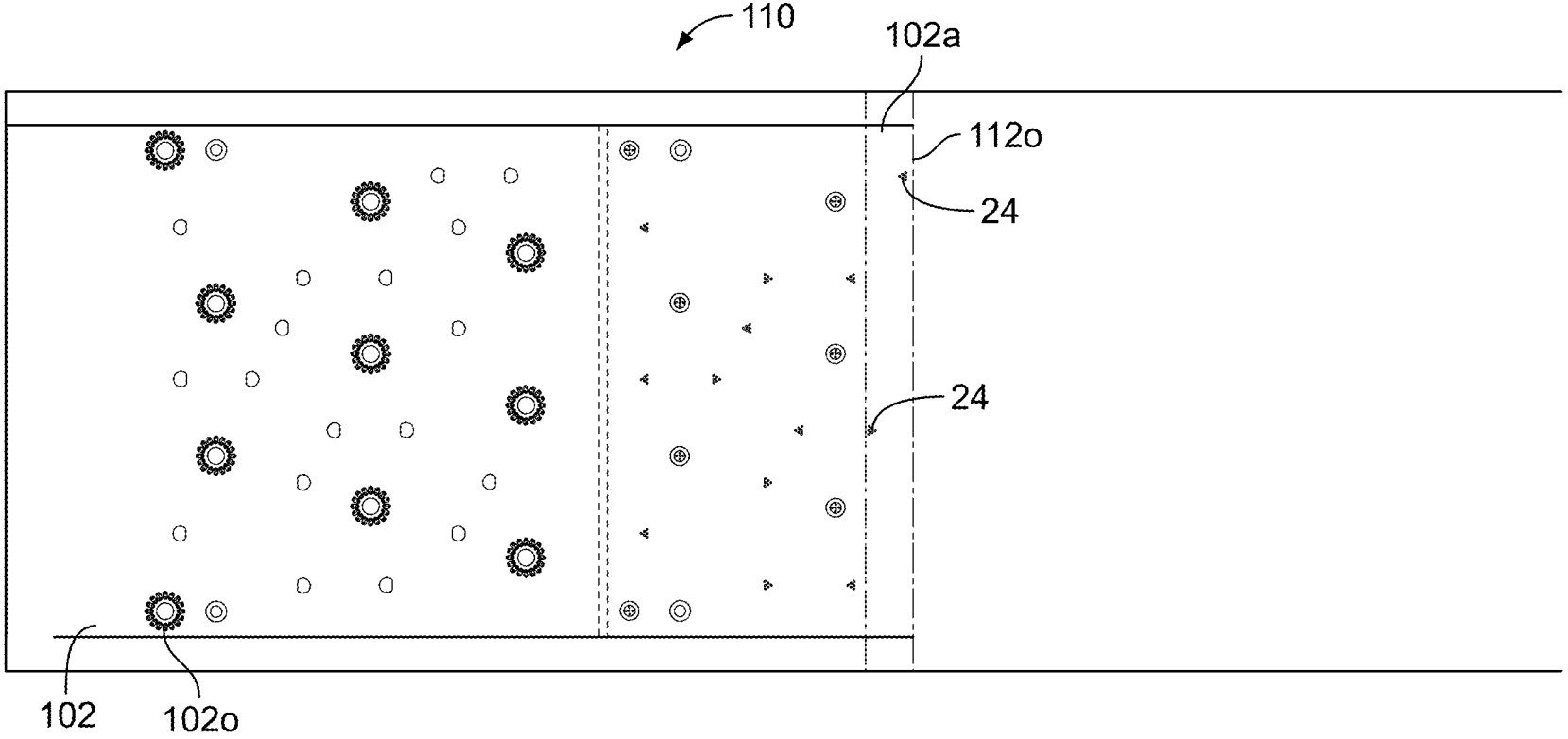
FIG. 27 is a top plan view of a fifteenth operation within the progressive die of the press of FIG. 12 in accordance with various embodiments of the present disclosure.
Figure 28:
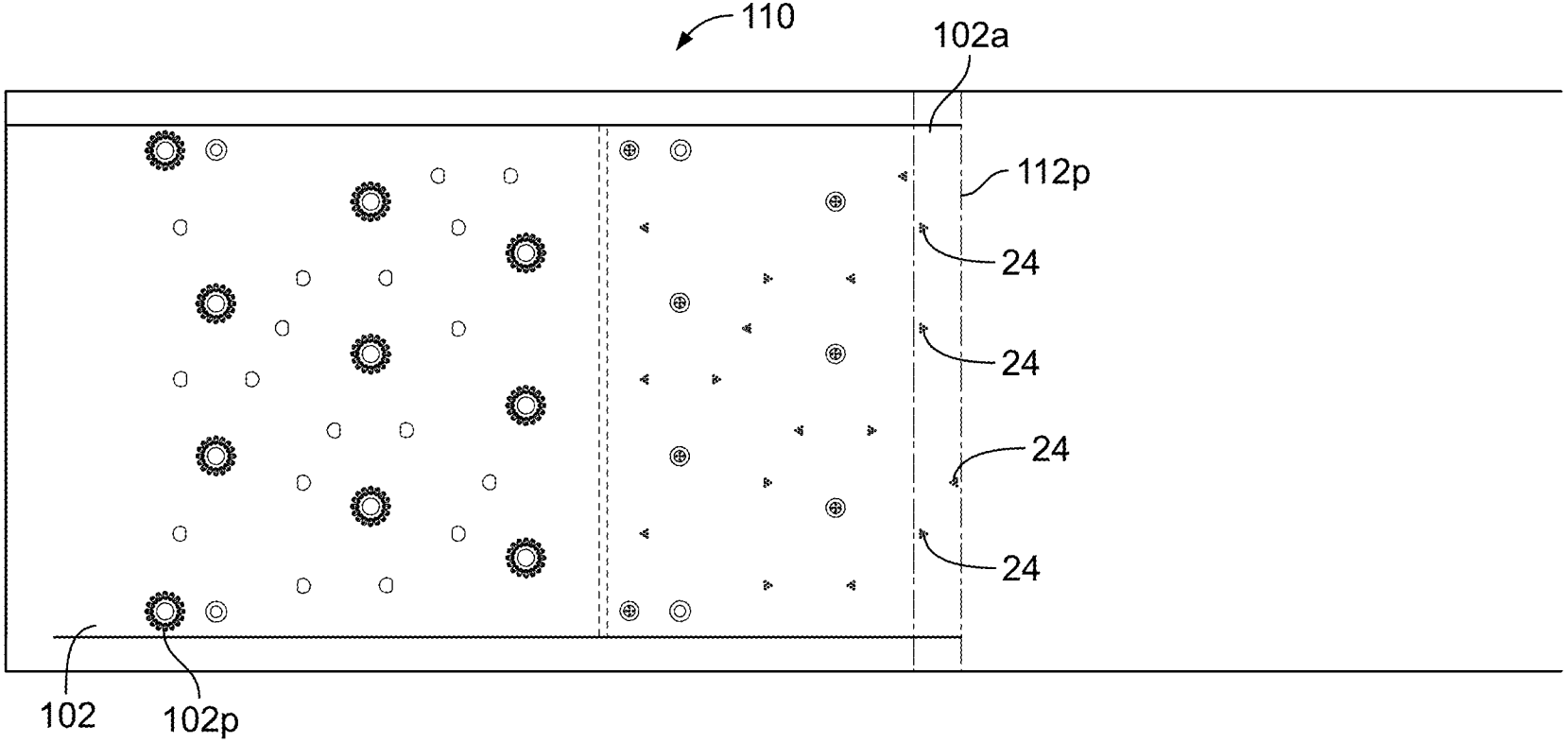
FIG. 28 is a top plan view of a sixteenth operation within the progressive die of the press of FIG. 12 in accordance with various embodiments of the present disclosure.
Figure 29:
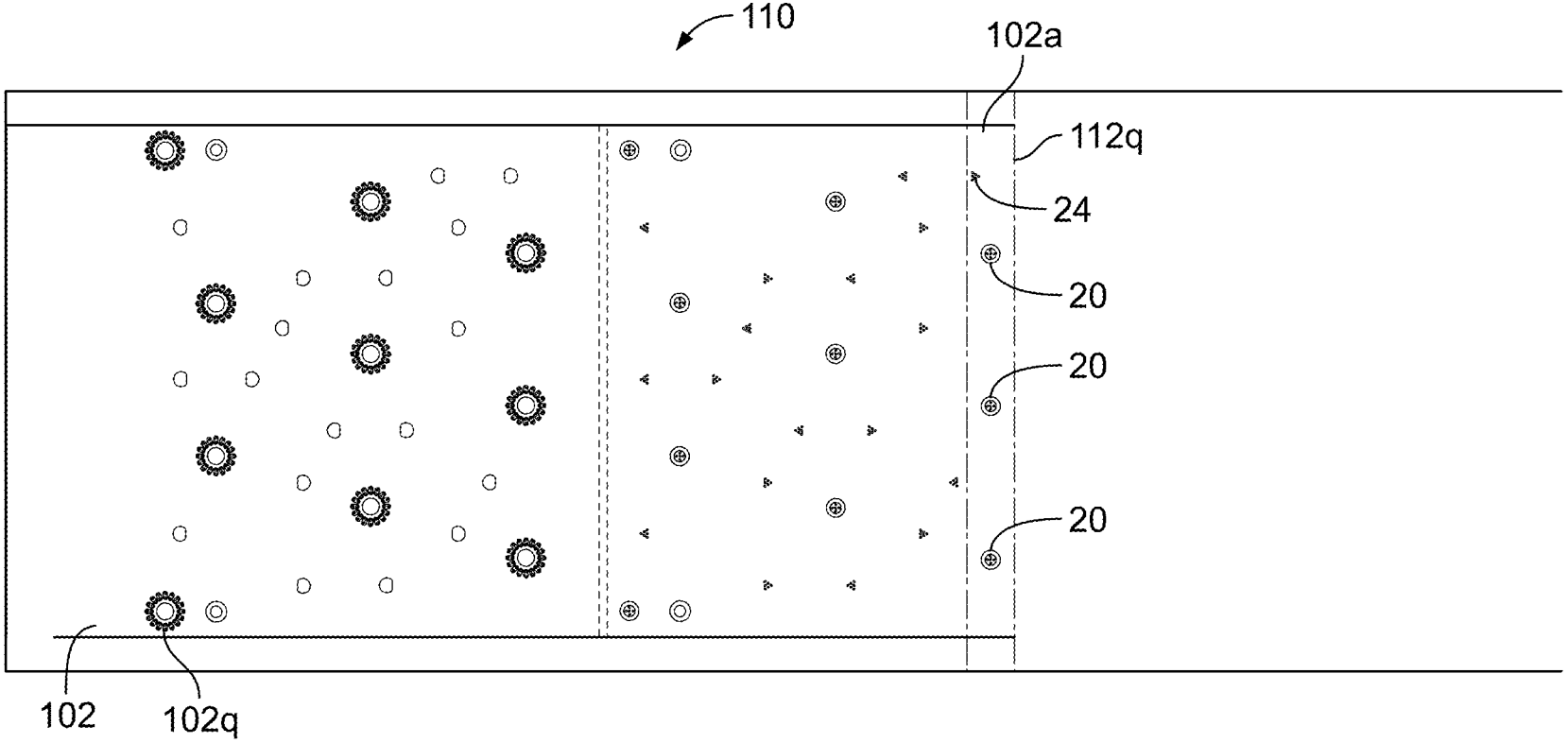
FIG. 29 is a top plan view of a seventeenth operation within the progressive die of the press of FIG. 12 in accordance with various embodiments of the present disclosure.
Figure 30:
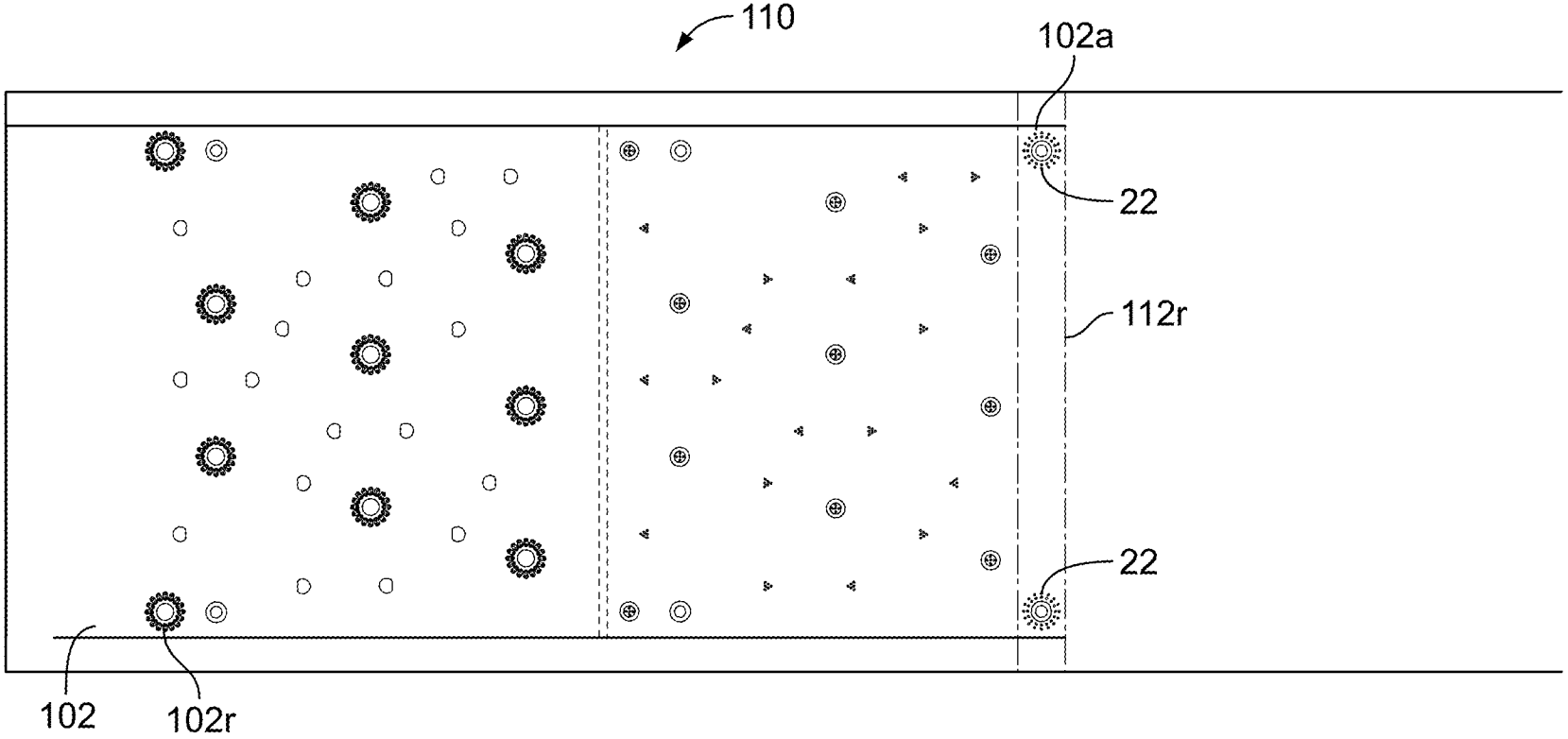
FIG. 30 is a top plan view of a eighteenth operation within the progressive die of the press of FIG. 12 in accordance with various embodiments of the present disclosure.
Figure 31:
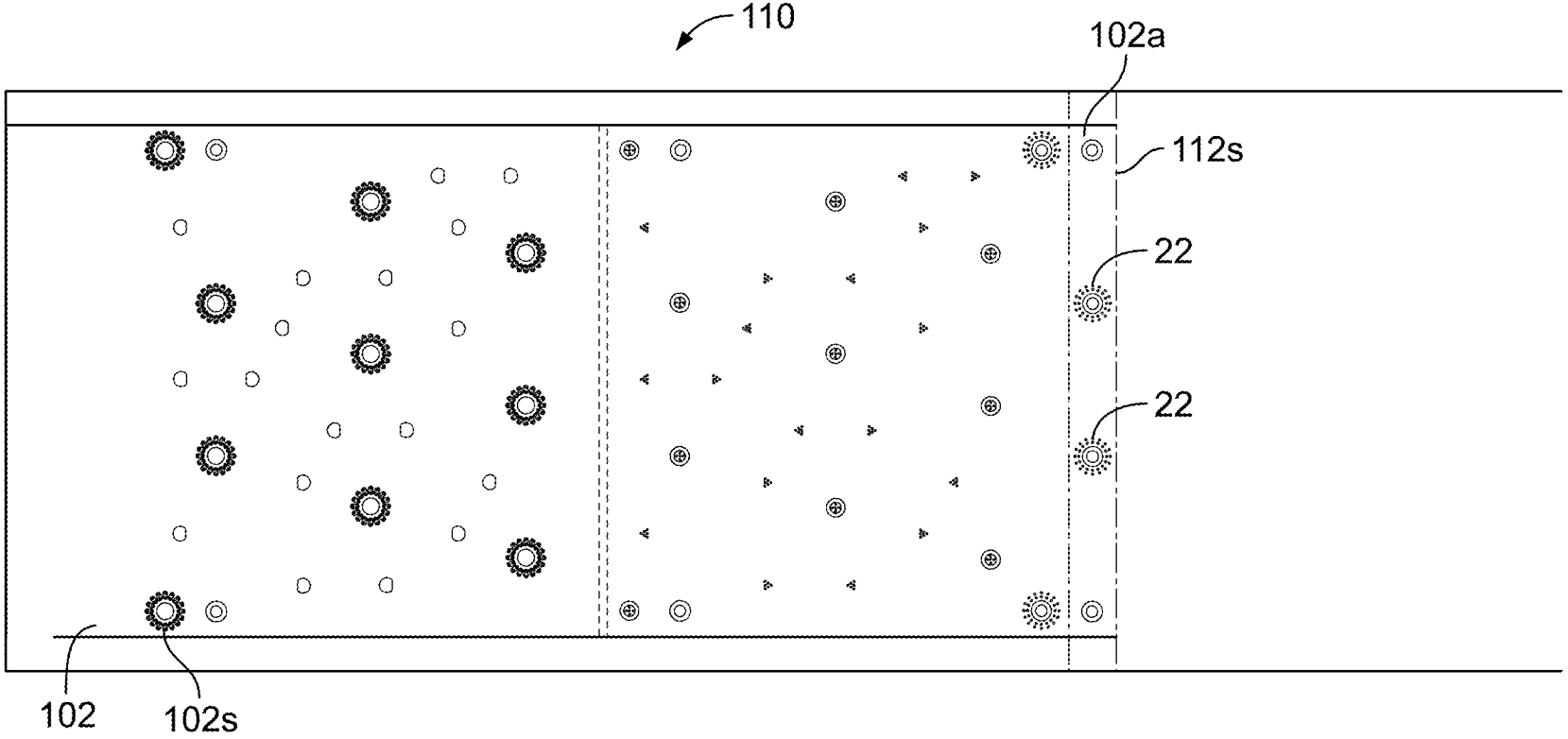
FIG. 31 is a top plan view of a nineteenth operation within the progressive die of the press of FIG. 12 in accordance with various embodiments of the present disclosure.
Figure 32:
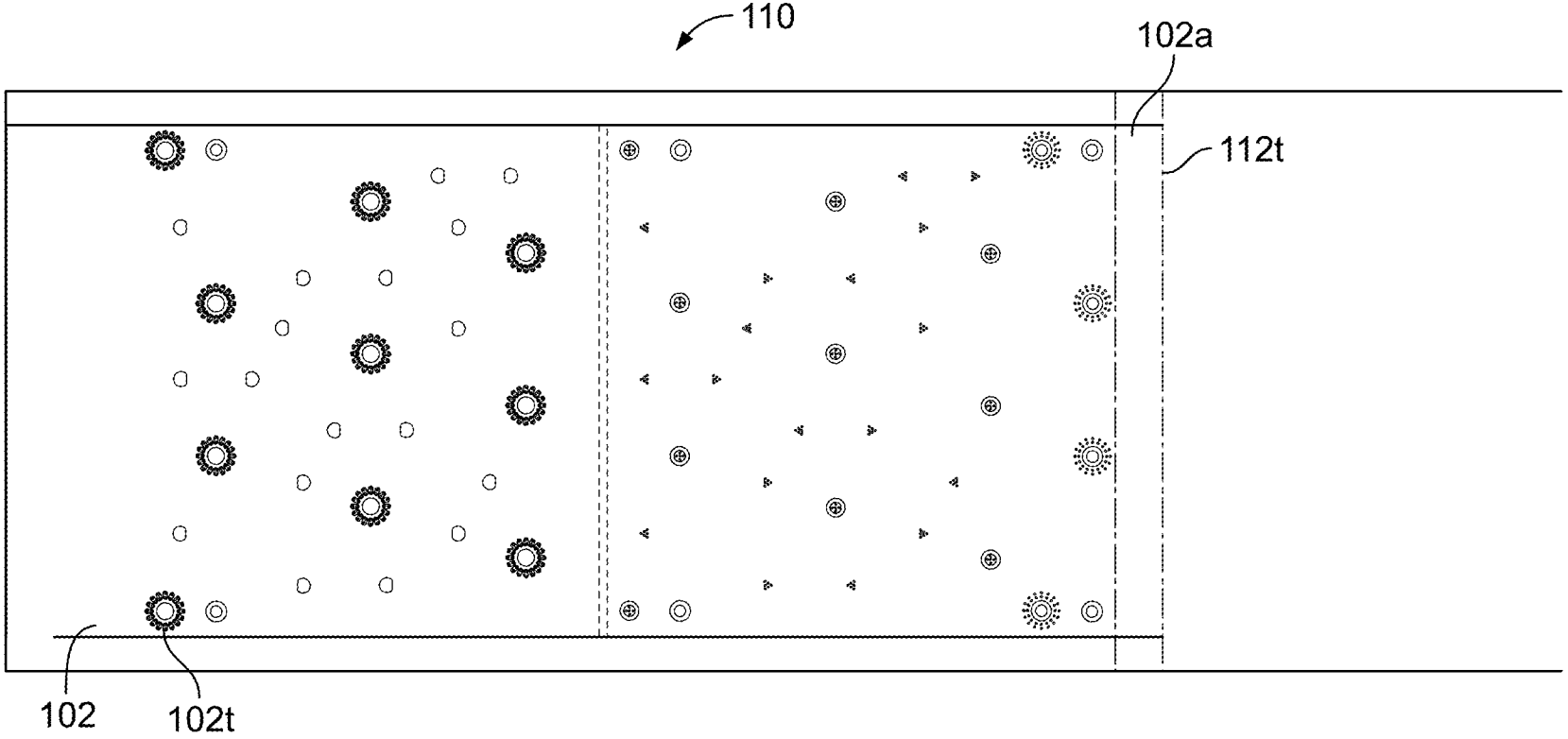
FIG. 32 is a top plan view of a twentieth operation within the progressive die of the press of FIG. 12 in accordance with various embodiments of the present disclosure.
Figure 33:
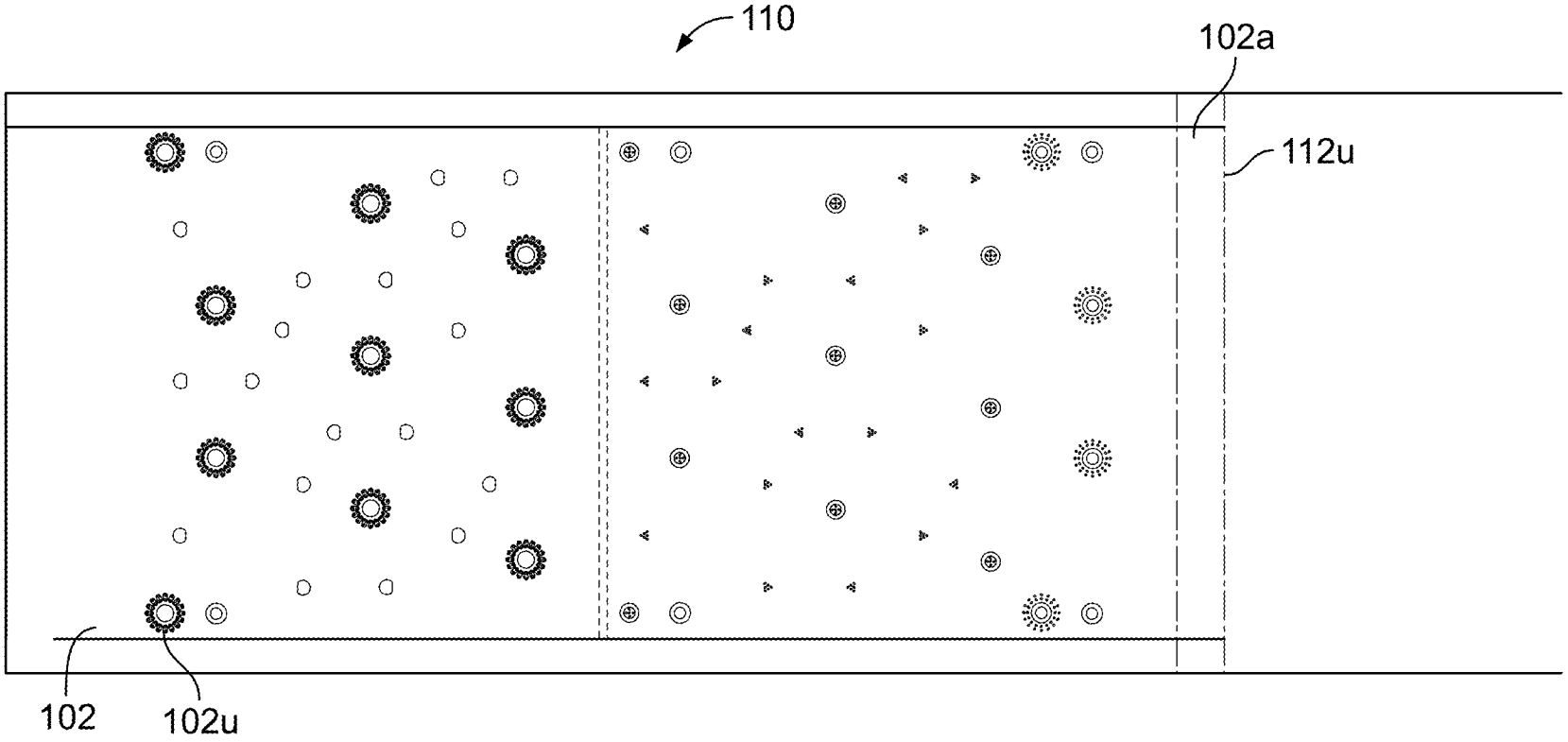
FIG. 33 is a top plan view of a twenty-first operation within the progressive die of the press of FIG. 12 in accordance with various embodiments of the present disclosure.
Figure 34:
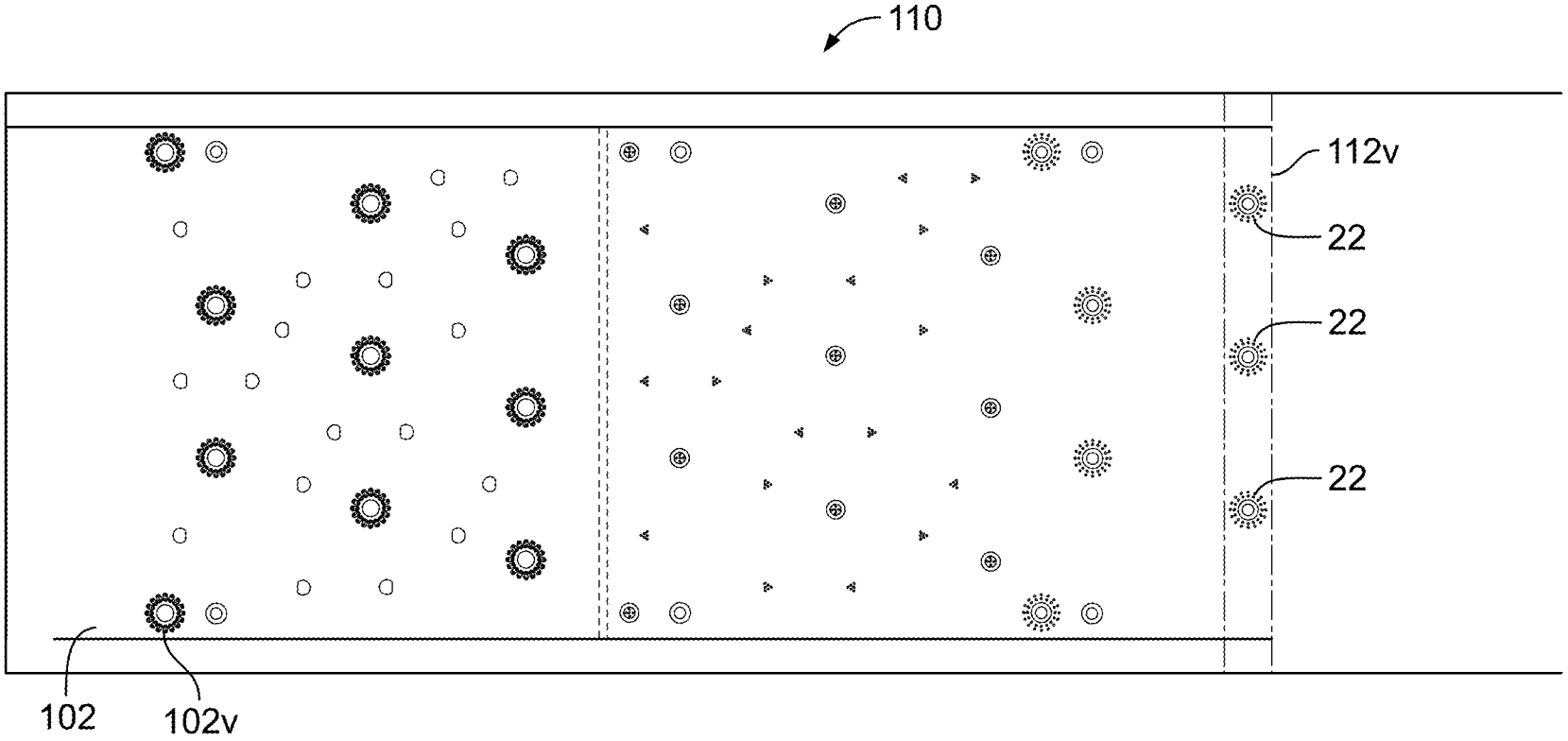
FIG. 34 is a top plan view of a twenty-second operation within the progressive die of the press of FIG. 12 in accordance with various embodiments of the present disclosure.
Figure 35:
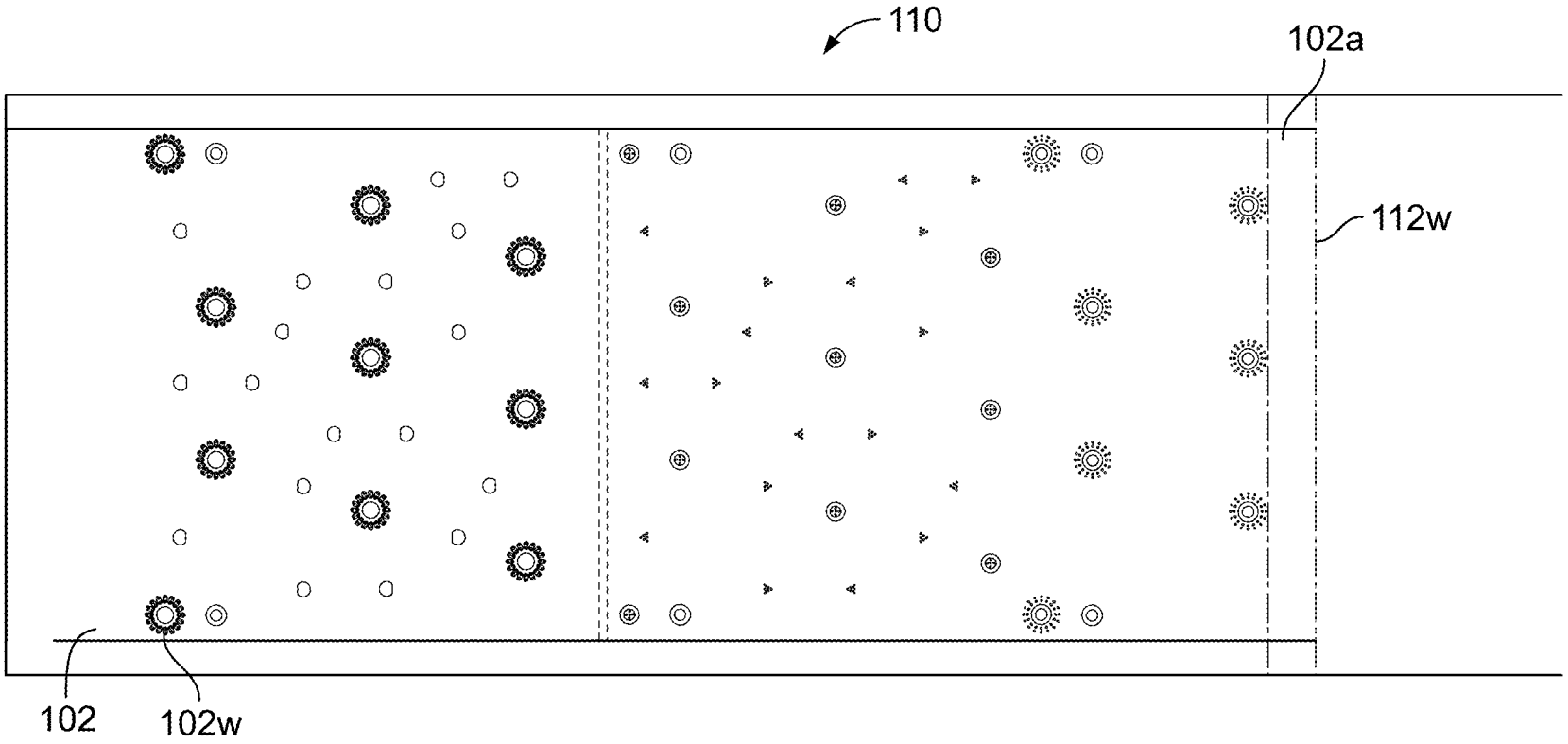
FIG. 35 is a top plan view of a twenty-third operation within the progressive die of the press of FIG. 12 in accordance with various embodiments of the present disclosure.
Figure 36:
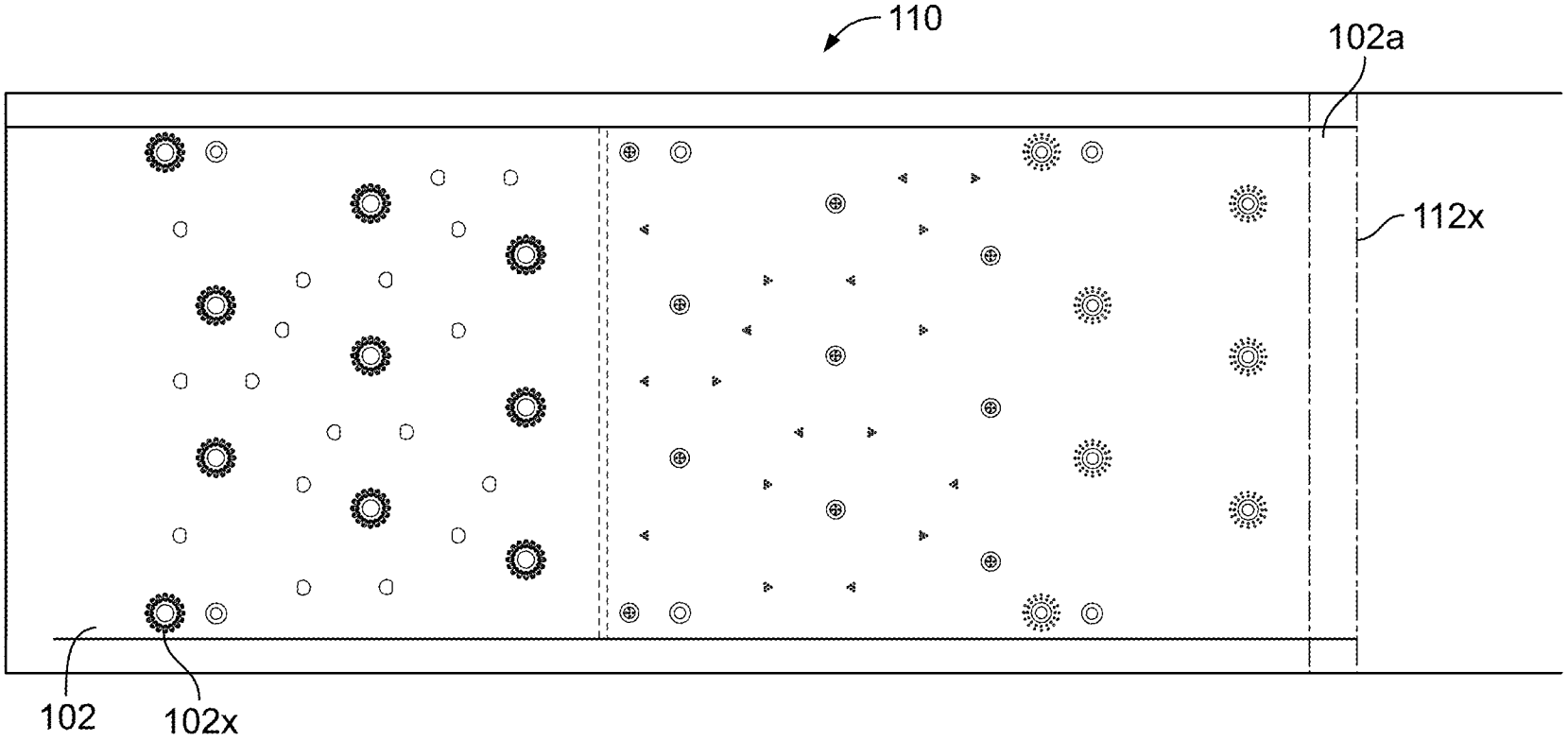
FIG. 36 is a top plan view of a twenty-fourth operation within the progressive die of the press of FIG. 12 in accordance with various embodiments of the present disclosure.
Figure 37:
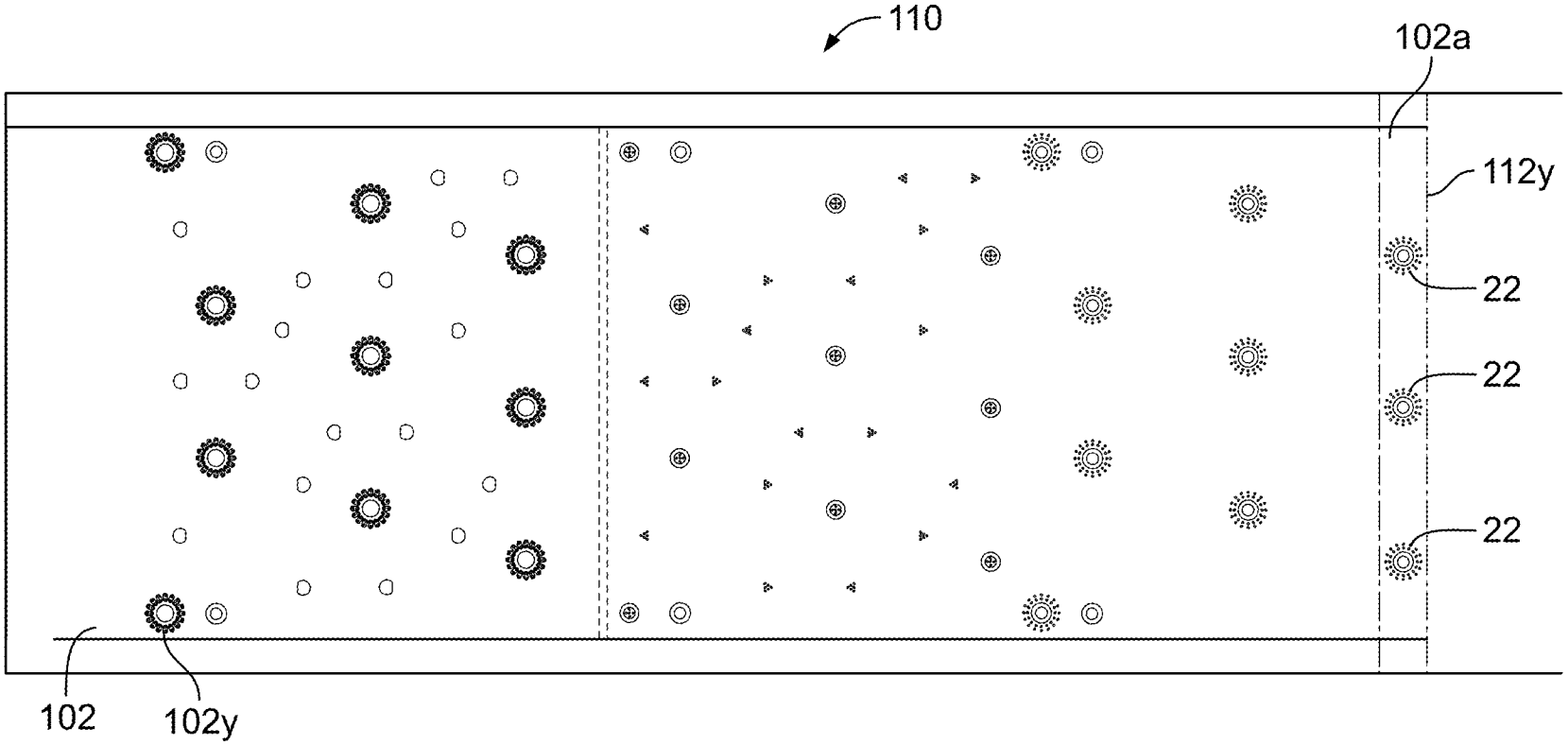
FIG. 37 is a top plan view of a twenty-fifth operation within the progressive die of the press of FIG. 12 in accordance with various embodiments of the present disclosure.
Figure 38:
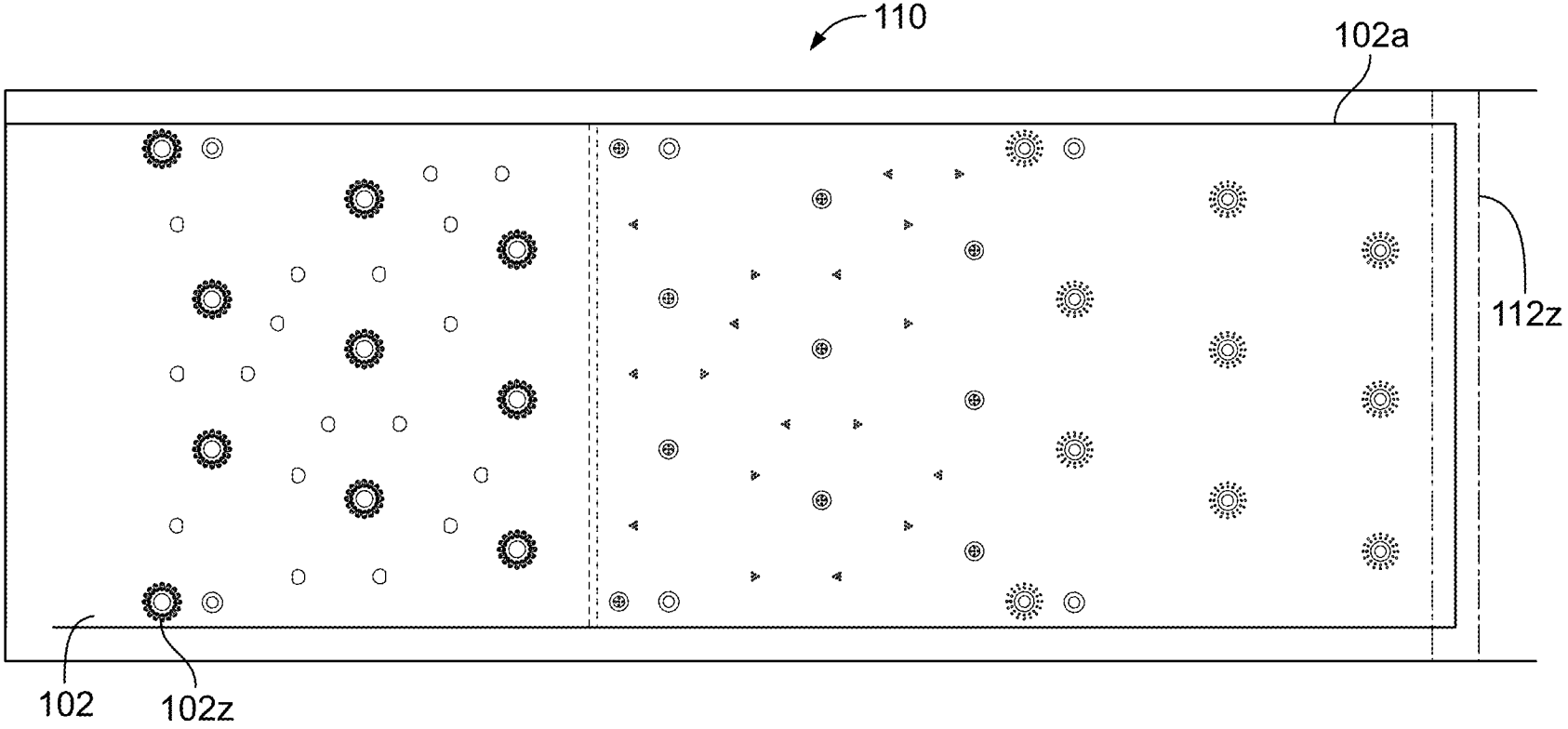
FIG. 38 is a top plan view of a twenty-sixth operation within the progressive die of the press of FIG. 12 in accordance with various embodiments of the present disclosure.

As illustrated in FIG. 21, the die 110 can optionally operate a ninth workstation 112*i* having a blade 124 (FIG. 11) configured to strike the first portion 102*a* of the steel sheet 102 or closely adjacent thereto to create the leveling rib 44 extending across the width of the steel sheet 102 to thereby counteract any curve or bow created in the sheet 102 due to the operations of the die 110 in the first through eighth workstations 112*a*-112*h*.

After the leveling operation, the die 110 performs a series of restrike operations to shape, e.g., flatten, compress, or form, the preform structures 48, 84, 86 created in the first through eighth workstations 112*a*-112*h* to create final forms for each. After subsequent advancements, the die 110 operates a tenth workstation 112*j* to coin the top and bottom domes 20 and three field areas 24, an eleventh workstation 112*k* to coin two intermediate domes 20, a twelfth workstation 112*l* to coin two field areas 24, a thirteenth workstation 112*m* to coin four field areas 24, a fourteenth workstation 112*n* to coin three domes 20 and two field areas 24, a fifteenth workstation 112*o* to coin two field areas 24, a sixteenth workstation 112*p* to coin four field areas 24, a seventeenth workstation 112*q* to coin three domes 20 and a field area 24, an eighteenth workstation 112*r* to coin top and bottom radial areas 22 around the domes 20, a nineteenth workstation 112*s* to coin two intermediate radial areas 22 around the domes 20, a twenty-second workstation 112*v* to coin three intermediate radial areas 22 around the domes 20, and a twenty-fifth workstation 112*y* to coin the final three intermediate radial areas 22 around the remaining domes 20. In the illustrated form, a twentieth workstation 112*t*, a twenty-first workstation 112*u*, a twenty-third workstation 112*w*, and a twenty-fourth workstation 112*x* are idle, not including structure to strike the first portion 102*a* of the steel sheet 102. So configured, the feeding mechanism 104 and the die 110 combine to produce a tile after a predetermined number of operations.

A twenty-sixth workstation 112*z* includes a blade 126 (FIG. 11) configured to be operated to cut off individual tiles 10 from the steel sheet 102 forming the trailing end edge 12 and, optionally, the leading end edge 12. The workstation 112*z* need not be operated until the tile 10 has reached a desired length. For example, the tile 10 can be cut to a square or rectangle shape. As shown, in FIG. 11, the press 108 includes a feed area 128 downstream of the blade 126 allowing larger tiles 10 to be advanced through the die 110 before cutting.

In a preferred approach, the longitudinal edges 130 of the steel sheet 102 can be pre-chamfered prior to processing in the die 110. Alternatively, if desired, the die 110 can be configured to shape longitudinal edges 130 of the steel sheet 102 to have a chamfered or rounded form such that the tile side edges 14 can be shaped before the tile 10 is cut from the steel sheet 102. For example, the edges 130 can be sequentially shaped in one or more of the workstations 112 by coining, grinding, or the like.

With this configuration, after the tile 10 has been cut from the steel sheet 102 by the blade 126, the tile 10 includes final forms of all desired tactile portions 16, as well as optionally including coined longitudinal edges 130. Thereafter, the tile 10 can be positioned within the single strike die 114 to perform secondary finishing operations. As illustrated in FIG. 1, the secondary finishing operations can include piercing holes 132 through the tile 10, which can be used, for example, to secure the tile 10 to a desired substrate using fasteners; stenciling text and/or other alphanumeric or graphical content 134; and coining leading and trailing end edges 12 of the tile 10 to have a chamfered or rounded shape.

Figure 39:
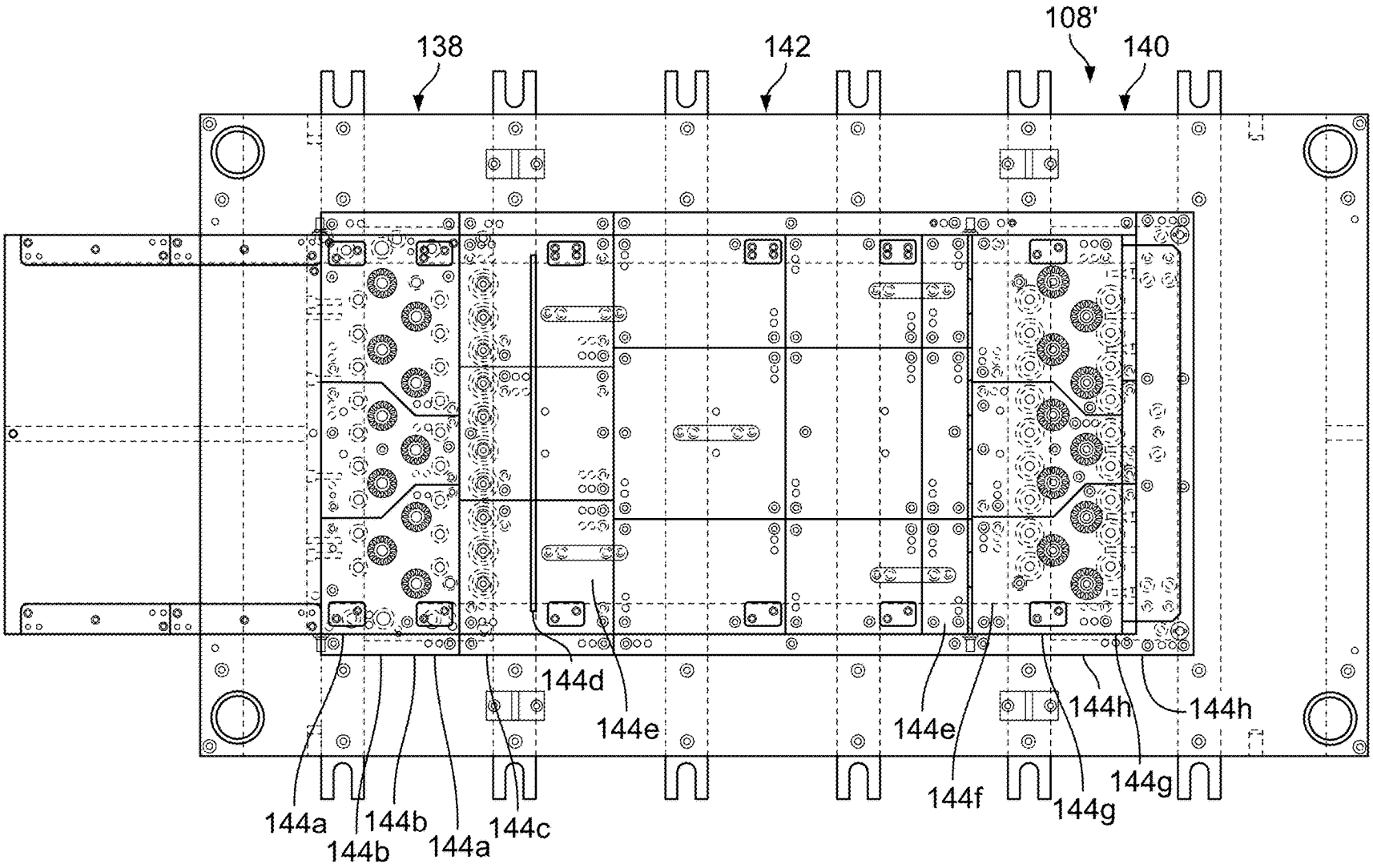
FIG. 39 is a bottom diagrammatic view of a second example press for the system of FIG. 10 in accordance with various embodiments of the present disclosure.

Another example press configuration is illustrated in FIG. 39. In this configuration, the press 108' distributes the preform and coining workstations to account for growth in the steel sheet 102 due to the forming of the metal during the coining operations. For example, each coining operation can cause a small amount of growth around the coined structure. With increasing numbers of coined structures, the growth can accumulate to undesirable amounts. Additionally, staggering coined structures along the length of a press may cause the structures, which are intended to be aligned, either perpendicular to the feed direction (latitudinally) or longitudinally (along the feed direction), to become slightly misaligned.

The press configuration shown in FIG. 39 advantageously aligns the preforming and coining workstations 144 with the point loads of the press 108' to orient the ram deflection of the press 108' as vertically as possible during the strikes. This is found to cause the growth due to the operations to be more uniform along the length and width of the steel sheet 102. Additionally, as shown in FIG. 39, each workstation 144 is dedicated to a particular tactile portion 16 or combination of tactile portions 16, so that the growth in the steel sheet 102 is uniform during the operation. It is recognized that reduction of longitudinal growth of the sheet may be more of a need for some materials than others. For instance, it is found that the phenomenon of longitudinal growth is less with 20 gauge carbon steel and stainless steel than with 10 gauge carbon steel. However, by configuring the preforming and coining workstations 144 in line with the point loads of the press in this manner, the press is able to mitigate the longitudinal growth when processing materials for which the longitudinal growth might otherwise be problematic, while having coining dies and punches that are easily resettable at each coining position for converting the press to accept other materials, such as when switching from 10 gauge carbon steel roll stock to stainless steel.

With the press 108' shown, the point loads are at a front portion 138 of the press 108' and a rear portion 140 of the press 108'. Accordingly, the preforming and coining operations are performed in the front and rear portions 138, 140 of the press 108' and an intermediate portion 142 of the press 108' is composed of idle workstations 144. More specifically, in the front portion 138, the press 108' includes a plurality of workstations 144 that are configured to strike the field preform structures 84 and strike the dome and radial preform structures 48, 86 across the width of the sheet 102.

In the illustrated form, the workstations 144*a* that are configured to strike the field preform structures 84 are disposed on either side of the workstations 144*b* that are configured to strike the dome and radial preform structures 48, 86, which are struck simultaneously. The dome and radial preform structures 48, 86 could also be formed using separate workstations 144. Further, as illustrated, the column of dome and radial preform structures 48, 86 can be distributed between two or more workstations 144*b*. In the illustrated form, the front portion 138 also includes a workstation 144*c* that is configured to coin the domes 20 across the width of the sheet 102.

If desired, the press 108' can include a leveling workstation 144*d* that is configured to form the leveling rib or recess 44 in the sheet 102. Following the leveling workstation 144*d*, the intermediate portion 142 includes a plurality of idle workstations 144*e*, such as thirteen as shown in FIG. 39.

After the intermediate portion 142, the rear portion 140 includes an optional edge coin workstation 144*f* that is configured to coin the longitudinal edges 130 of the sheet 102. The rear portion 140 further includes one or more workstations 144*g* that are configured to coin the field areas 24 and one or more workstations 144*h* that are configured to coin the radial areas 22. In the illustrated form, the press 108' includes field area workstations 144*g* on either side of two radial area workstations 144*h*. At the end of the rear portion 140, the press 108' includes a cutting blade 122' that can be operated to cut the sheet 102 to tiles 10 of desired lengths. Advantageously, utilizing the front and rear portions 138, 140 of the press 108' with preform and coining strikes distributed as shown and described, it is found that undesirable lengthening of the steel sheet 102 due to the strikes is minimized.

The configuration of the press 108' can also be utilized to counteract growth in the steel sheet 102 due to the coining operations of the truncated domes 20. By a first approach, the punch and die pairs configured to coin the radial areas 22 and/or field areas 24 can be adjusted upwardly so that the excess metal is incorporated into the radial and/or field areas 22, 24. By another, or alternative approach, the leveling workstation 144*d* can be adjusted so that the leveling rib or recess 44 incorporates the excess metal.

In one example for one type of steel, such as 10 gauge carbon steel, in the configuration illustrated in FIG. 39, the longitudinal growth due to the coining operations may amount to approximately 0.6 inches for a five foot section of the steel sheet 102. To counteract this growth, by adjusting the spacing between the punch and die at each of the coining positions, the height of the radial areas 22 can be raised during the coining operation by about 0.02 inches. Accordingly, the final radial areas 22 can have a height of about 0.03±0.01 inches. It should be understood, however, that the particular steel being used in the process affects the growth during the coining operations. For example, 10 gauge carbon steel can be expected to have larger growth as compared to the relatively thinner 20 gauge carbon steel or the relatively harder 12 gauge stainless steel.

Moreover, the preform and coining operations described herein advantageously strengthen the steel of the resulting tile 10 by virtue of work hardening. Both stretching the steel in the preform operations and compressing the steel in the coining operations increases the hardness, yield strength, and tensile strength of the steel.

Figure 40:
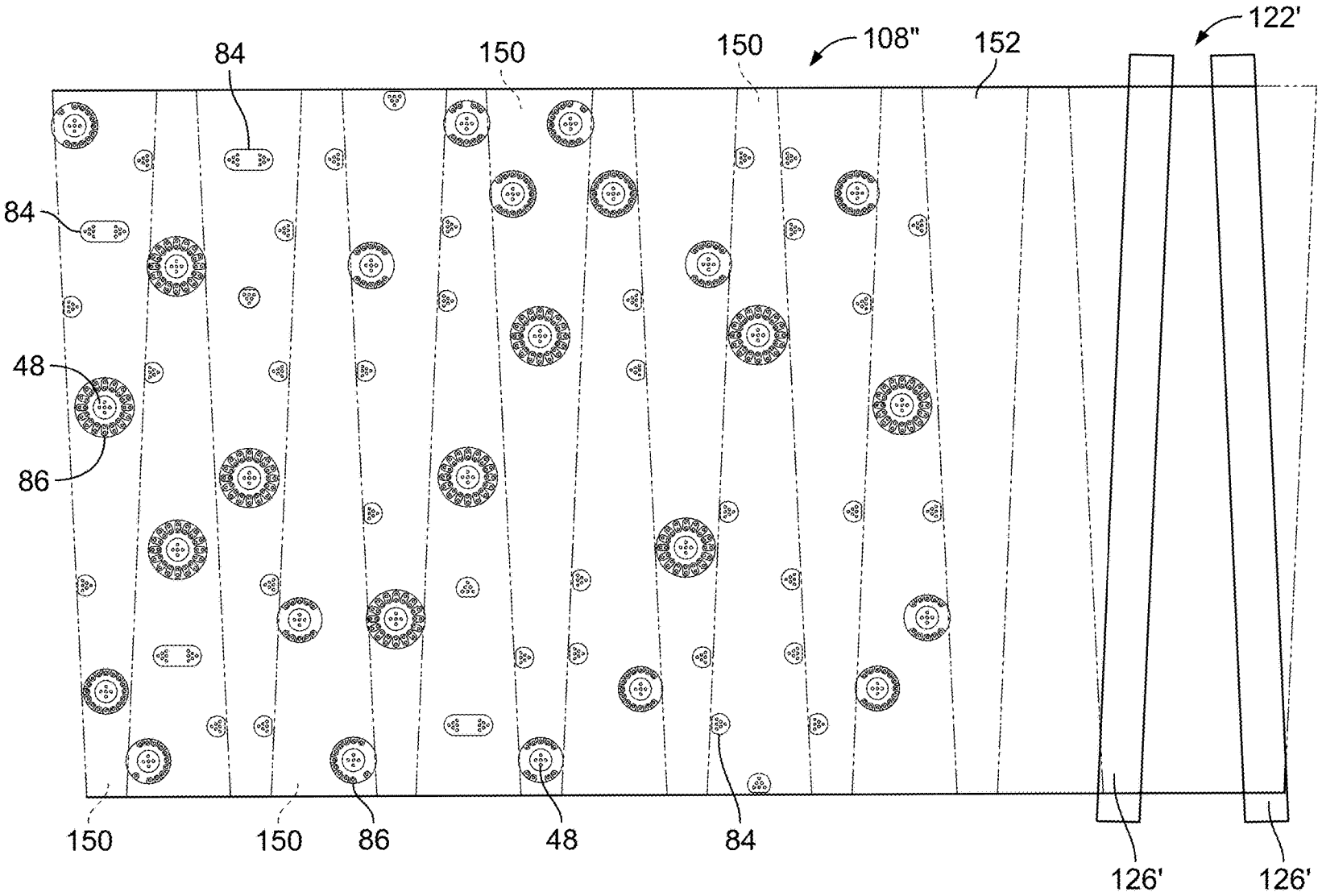
FIG. 40 is a bottom diagrammatic view of a third example press for the creation of wedge-shaped detectable warning tiles in accordance with various embodiments of the present disclosure.
Figure 41:
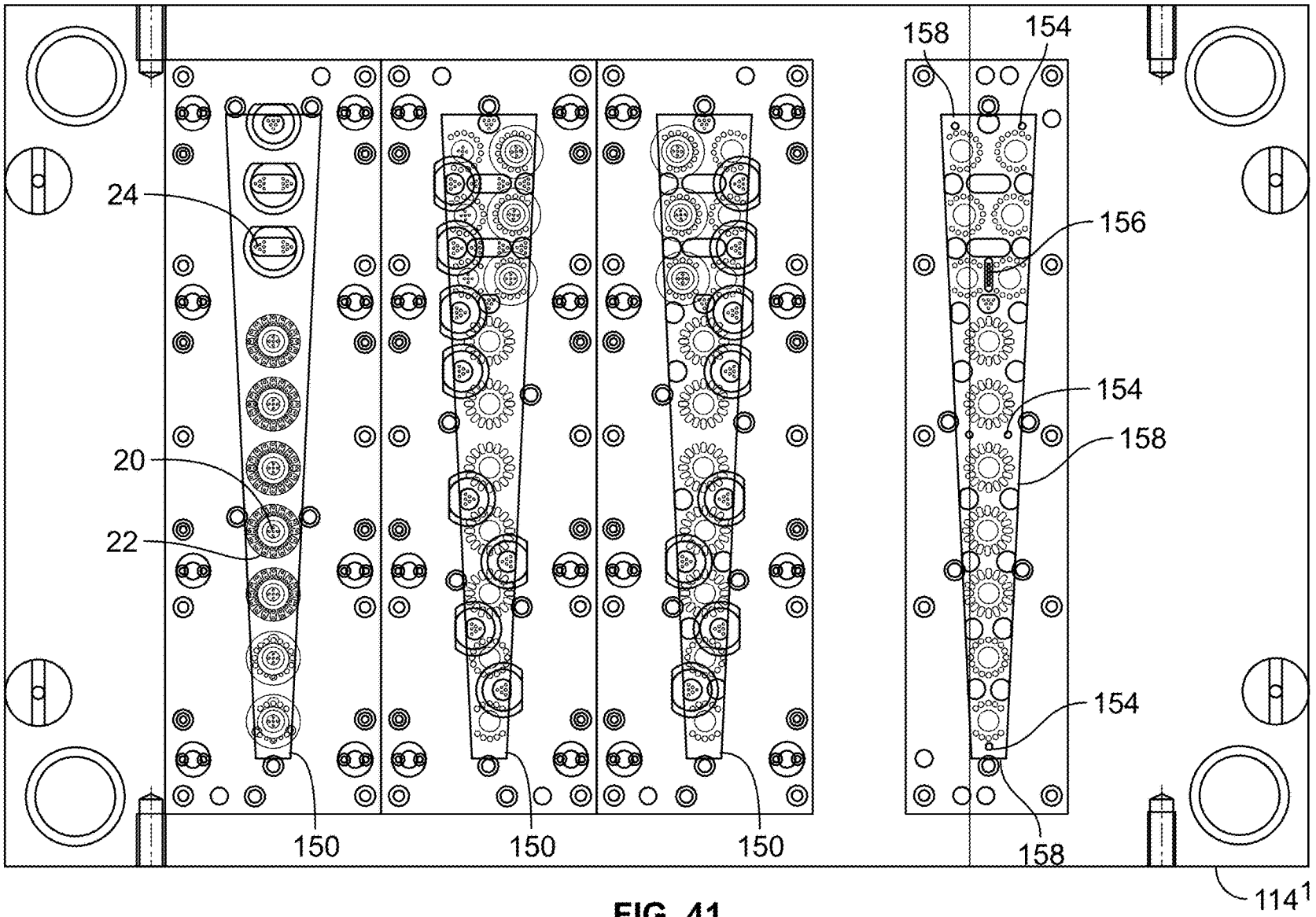
FIG. 41 is a bottom diagrammatic view of a fourth example press for the creation of wedge-shaped detectable warning tiles in accordance with various embodiments of the present disclosure.

The techniques and configurations described herein are also particularly suitable for the creation of steel tiles having shapes other than rectangular as previously discussed. For example, wedge-shaped tiles 150 having a trapezoidal shape as shown in FIGS. 40 and 41 can be utilized to apply detectable tiles over a radiused sidewalk, such as a curved corner or entranceway. Conventional injection molded wedge-shaped tiles are described in co-owned U.S. Pat. Nos. 9,770,383 and 9,814,649, which are hereby incorporated by reference. By employing the methodologies disclosed herein, steel tactile tiles having such a beneficial wedge shape can be formed.

In a first operation, shown in FIG. 40, preform structures for any desired tactile portions, such as the preform structures 48, 84, 86 discussed above, can be formed in a steel sheet 152, where the wedge-shaped tiles 150 are configured to be sequentially flipped in an alternating orientation pattern, along the length of the steel sheet 152. This nesting configuration advantageously minimizes scrap in the process. As shown, the wedge tiles 150 can include any suitable combination of domes, radial areas, and field areas 20, 22, 24 disposed along the length and width thereof. With this configuration, the cutting section 122' of the press 108" can include two cutting blades 126' disposed at desired angles with respect to the longitudinal axis of the press 108" and steel sheet 152 to cut the wedge tiles 150 off of the steel sheet 152.

Thereafter, in a second operation, as shown in FIG. 41, the wedge-shaped tiles 150 with the preform structures 48, 84, 86 can be inserted into a second press 114' to coin the preform structures 48, 84, 86 into domes 20, radial areas 22, and field areas 24. Additionally, the second press 114' can be utilized to perform secondary finishing operations on the wedge-shaped tiles 150, as discussed above. The secondary finishing operations can include piercing holes 154 through the tile 150, which can be used, for example, to secure the tile 150 to a desired substrate using fasteners; stenciling text and/or other alphanumeric or graphical content 156; and coining any edges 158 of the tile 150 to have a chamfered or rounded shape.

While the above systems and methods are suitable for many purposes, it has been found that a more consistently flat final tile product can be achieved by utilizing the below methods and systems. More specifically, one condition that may impact a final product's flatness is the steel becoming misaligned within the press during the various stamping processes. It has been found that many factors can influence the alignment of the steel within the press including: growth resulting from coining processes, thickness variation, shut height and tonnage settings of the press, press feed and stamping speed, material hardness, and lubrication, to name a few.

Accordingly, the following systems and methods are provided to control both material gage and alignment of the steel within the press during the tile formation process. In one example, misalignment can occur within the press due to growth in the steel during the forming processes. When forming steel, the steel is being moved around both in vertical and horizontal directions. For the purposes of the following disclosure, "product growth" refers to growth in the horizontal direction. As described above, the various tactile features 16 are coined to form the final desired configurations. Some of the product growth resulting from these operations can be incorporated into the vertical height of other features 16. For example, some or all of the product growth resulting from coining the domes 20 can be incorporated into the vertical height of the radial areas 24 surrounding the domes 20. Some material, however, may nonetheless undesirably cause horizontal growth in the tile. While undesirable in itself, the horizontal growth may be non-symmetric with regard to the feed direction, causing portions of the steel to become misaligned within the press. Alignment of the steel during the tile formation process can also be affected by the feeding process through the press. While the press may contain stock guides to generally contain the steel, there is enough tolerance between the stock guides to allow the steel to shift or move around such that the preform structures 48, 84, 86 and the final form operations are not consistently aligned. Moreover, a first misalignment may be exacerbated during subsequent operations further deviating the part from desired dimensions and flatness.

Figure 42:
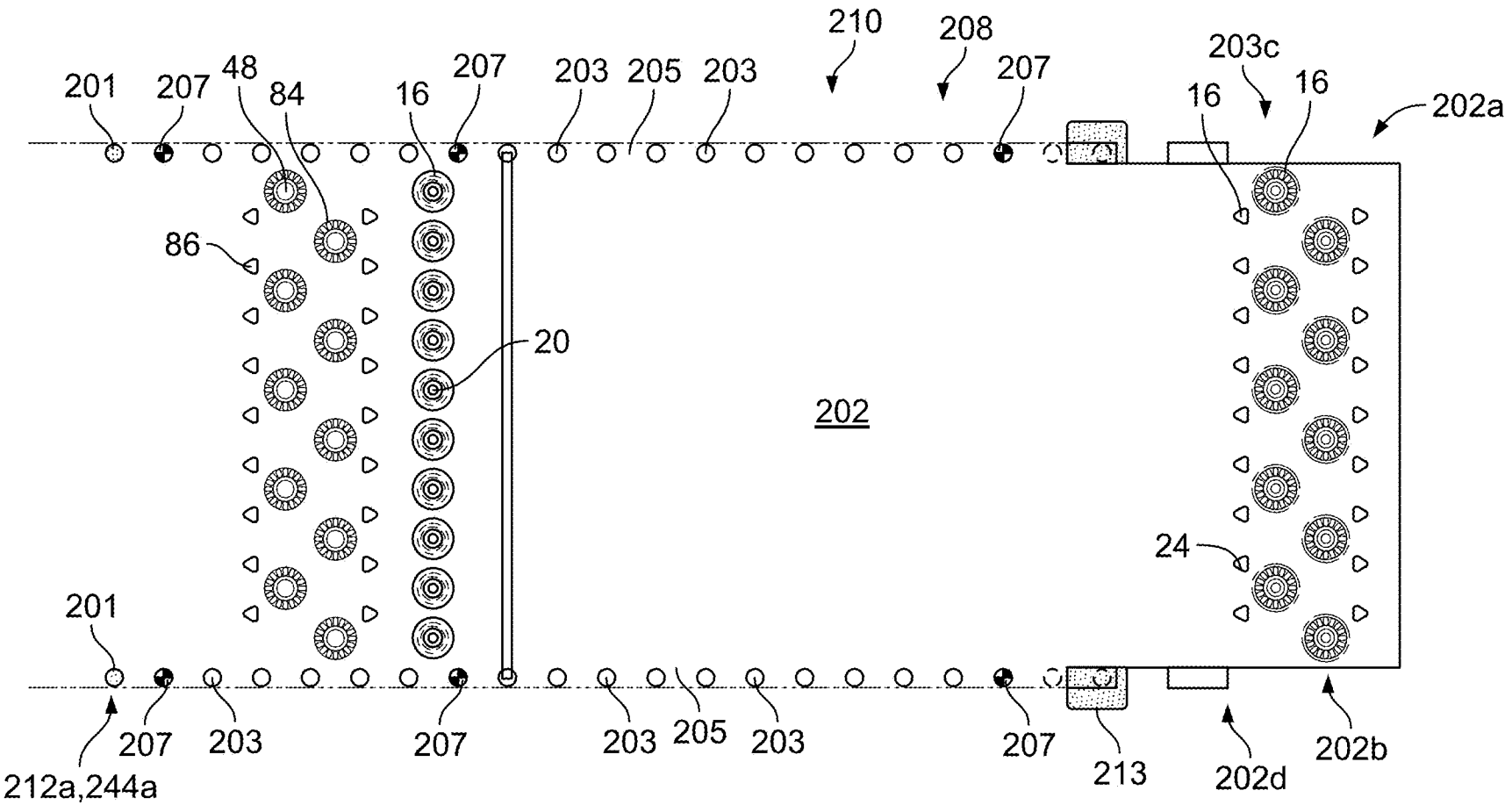
FIG. 42 is a top diagrammatic view of another example system layout for creating a tile having an array of tactile portions in accordance with various embodiments of the present disclosure.
Figure 43:
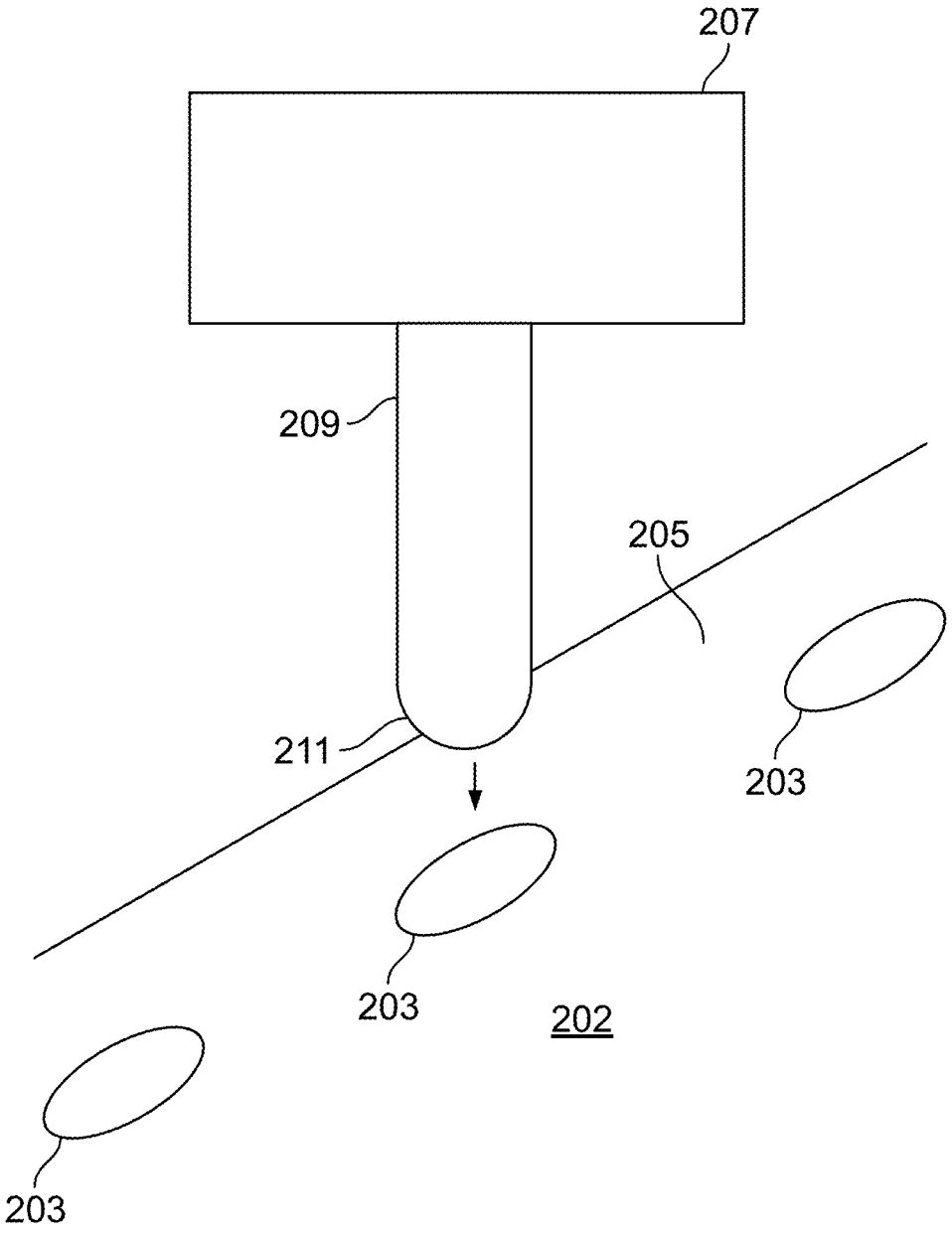
FIG. 43 is a sectional perspective view of a pilot punch for registering a sheet of steel in accordance with various embodiments of the present disclosure.

An alignment system and method for use with the above-described processes is shown in FIGS. 42 and 43. Many of the components of these embodiments are similar to the above disclosure and, as such, similar components have similar reference characters and the differences will be described hereinafter.

In this form, a first workstation 212*a,* 244*a* of a die 210 for a press 208 includes punch tools 201 disposed outwardly of any punch and die pairs configured to produce the preform structures 48, 84, 86. The punch tools 201 are configured to punch holes 203 through a first portion 202*a* of steel 202 being fed through the die 210 in laterally outer edge portions 205 thereof. In the illustrated form, the steel 202 includes excess material in a width dimension with respect to the desired width of the final tile 10 to provide space for the holes 203 to be located laterally outwardly from the final tile 10 width dimensions. For example, the steel 202 can have an extra inch or between about 0.5 inch to 1.5 inch on either side thereof. In one example, the holes 203 can have about 0.75" or about 0.5" diameter. Of course, locating the holes 203 between tactile portions 16 within a desired width of the final tile width is also possible.

Further, by virtue of providing the punch tools 201 on the first workstation 212*a,* 244*a,* corresponding holes 203 will be provided spaced along the length of the steel 202 in the second portion 202*b,* third portion 202*c,* fourth portion 202*d,* etc. thereof due to the feed lengths provided by the feed mechanism 104. As set forth above, the feed lengths can be about 2.37".

With this configuration, the steel 202 will have a series of holes 203 spaced along the laterally outer edges 205 thereof. The die 210 can utilize the holes 203 to both align and hold the steel 202 during stamping processes. As shown in FIG. 42, one or more of the workstations 212, 244 after the first workstation 212*a,* 244*a* can include a registering pilot punch 207 disposed on lateral portions of the workstations 212, 244 to be aligned with the punch tools 201. The pilot punches 207 are configured to be inserted through the holes 203 to register the steel 202 as it is fed through the die 210. The punch 207 can have a shaft 209 with a rounded or bulleted end 211. The shaft 209 can have a cross-sectional shape complementary to a shape of the hole 203 and a diameter equal to or substantially equal to, e.g., within about 1/32 inch of the diameter of the hole 203. Alternatively, the diameter of the shaft 209 can be in a range of about 1/32 to about 1/8 of an inch or within about 1/32 to about 1/16 of an inch of the hole 203. The rounded or bulleted end 211 of the punch 207 allows the punch 207 to be inserted through the hole 203 even if the punch 207 is not perfectly aligned with the hole 203. Thereafter, the punch 207, by virtue of the diameter thereof, will realign or register the steel 202 to a desired orientation by the steel 202 sliding along the punch 207. The punches 207 can be provided in as many workstations 212, 244 as desired. For example, punches 207 can be provided in one or more workstations 212, 244 that perform coining operations, such as the field area workstations 244*g,* the dome workstation 244*c,* and/or the radial areas workstations 244*h,* two, three, or more workstations 212, 244 evenly spaced along a length of the die 210, the second workstation 212*b,* 244*b,* a workstation 212, 244 adjacent to a trimming operation described in more detail below, or combinations thereof.

The system can further include notching tools 213 in a desired workstation 212, 244 that are configured to cut off the excess width edge portions 205 of the steel 202. The notch tools 213 can have a width generally equal to a feed length of the feed mechanism 104, such as about 2.37" as discussed above. So configured, the notch tools 213 will sequentially cut off the edge portions 205 of the steel 202 toward or at the end of the stamping process, while the holes 203 and pilot punches 207 ensure that the steel 202, and the tactile structures 16 thereon, are aligned within the die 210 within desired tolerances. In one example, the notching tools 213 can be disposed in a workstation 212, 244 spaced from a last workstation 212, 244 by one, two, three, four, or five workstations 212, 244. In another example, the notching tools 213 can be disposed in the last workstation 212, 244 of the process. Alternatively, the steel 202 can be fed entirely through the press 208 with the edge portions 205 and another die can be utilized to sequentially cut sections or cut the entire length of the edge portions 205 off the steel 202. In any of the above example, a pilot punch 207 can be disposed on a workstation 212, 244 adjacent to or within two workstations of the workstation 212, 244 including the notching tools 213.

A result of this process is a tile 10 having a desired width, as well as, a desired flatness. As utilized herein, a desirably "flat" tile 10 can correspond to the condition of a 0.09" diameter pin being unable to pass under a tile when the tile is lying on a flat surface. Accordingly, the above alignment system and method uses a counterintuitive process of adding width and material that will end up as scrap to mitigate a width growth problem.

Another condition that may impact a final product's flatness is the variation of the material's cross-sectional thickness in a horizontal direction through the steel 102, 202. It has been found that if the variation of the cross-sectional thickness or "gage" is 0.004" or greater, the resulting tile 10 is more likely to not be flat, while if the variation of the cross-sectional thickness is 0.002" or less, the resulting tile 10 is likely to be flat. Accordingly, in one approach, the steel 102, 202 can have a cross-sectional gauge of about 0.002" or less and preferably about 0.0015" or less.

In some examples, the press 108 can be a 2000 ton press and the single-strike press 106 can be a 600 ton press. Tool materials can include tool steel, A2, D2, and S7 per tool designs. Regarding suitable steel 102, for example, mild steel can be utilized, ASTM A1011 type B, with Boron added. This steel has a tensile strength of 44-48 Ksi, a yield strength of 27-33 Ksi, and % elongation of 40-46%. A 10 gage, 0.127"-0.135", or a 12 gage (without Boron added), 0.097"-0.105", thickness can be utilized. In another example, stainless steel can be utilized, ASTM A240, 304. This steel has a minimum tensile strength of 75 Ksi, a minimum yield strength of 30 Ksi, and a % elongation of 40%. A 12 gauge, 0.097"-0.105", thickness can be used.

Figure 44:
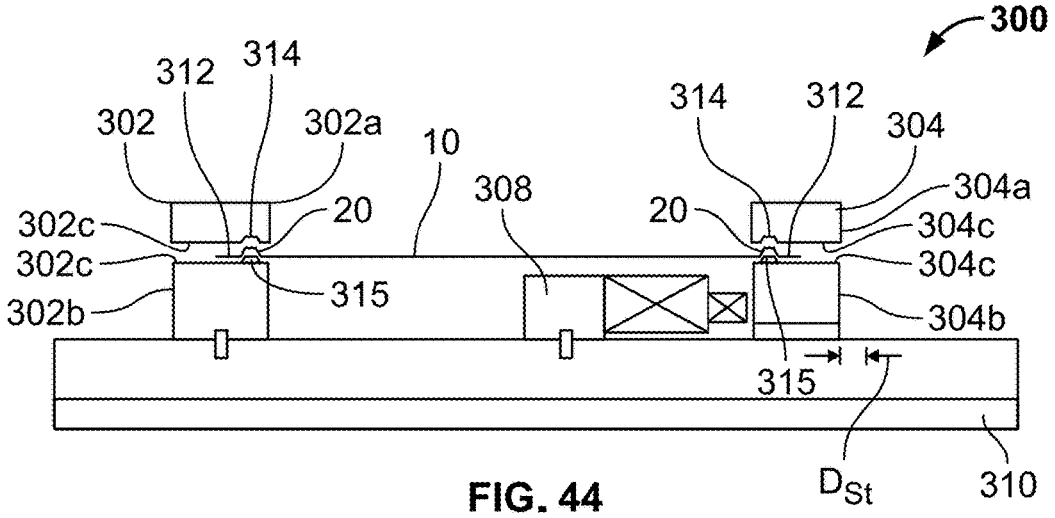
FIG. 44 is a side diagrammatic view of a stretching assembly in accordance with various embodiments of the present disclosure.
Figure 45:
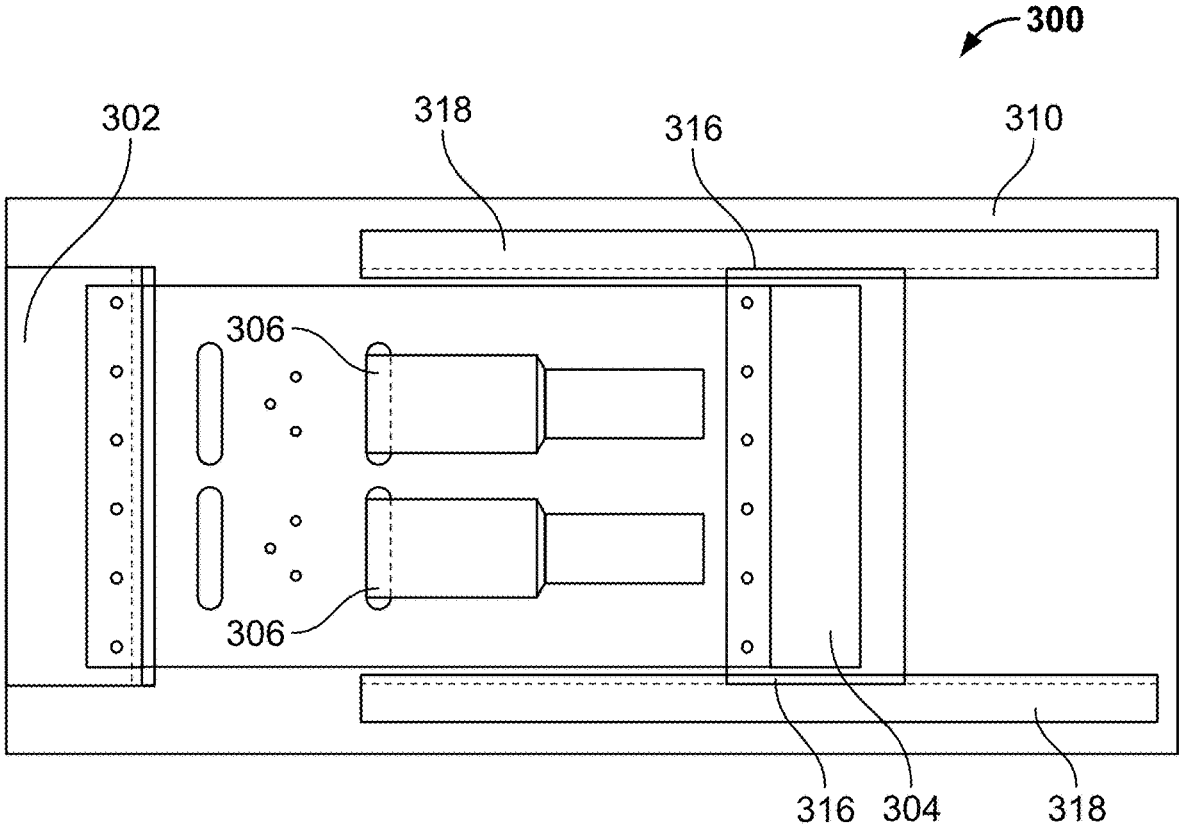
FIG. 45 is a top diagrammatic view of the stretching assembly of FIG. 44 in accordance with various embodiments of the present disclosure.

While the above disclosures may be utilized to produce satisfactory tiles, in order to correct or achieve a further desired flatness, formed tiles 10 can be stretched by a stretching assembly 300 as shown in FIGS. 44 and 45 to achieve a flatter tile. The stretching assembly 300 includes a stationary clamp 302, a mobile clamp 304, and one or more hydraulic cylinders 306, such as two disposed side-by-side as shown in FIG. 45, having one anchored end and an opposite end operably coupled to the mobile clamp 304 to shift the mobile clamp 304 away from the stationary clamp 302. The anchored end of the hydraulic cylinders 306 can be mounted to a block 308 secured to a work surface 310. Each of the clamps 302, 304 can include upper and lower members 302*a,* 302*b,* 304*a,* 304*b* that can be moved with respect to one another so that end edges 312 of a tile 10 can be disposed therebetween. Thereafter, the members 302*a,* 302*b,* 304*a,* 304*b* can be moved towards one another to clamp the end edges 312 of the tile 10. The clamps 302, 304 can be operated by any suitable drive mechanism, including hydraulics, electrical, manual, etc. Further, as shown, the clamps 302, 304 can have a width sufficient to receive a full width of the tile 10 therein. In one form, the lower members 302*b,* 304*b* of the clamps and the block 308 can have upper surfaces that are generally planar so that the tile 10 can rest on the surfaces when being secured within the assembly 300 with the upper members 302*a*, 304*a* being moved downwardly to clamp the tile 10.

In some versions, one of the members 302*a*, 302*b*, 304*a*, 304*b* of each of the clamps 302, 304 can include cavities 314 to align with the domes 20 formed in the tile 10. In one approach, the cavities 314 can be spaced apart from one another along a width thereof to receive individual ones of the domes 20. In another approach, the cavities 314 can extend across a portion of the width of the member 302*a*, 302*b*, 304*a*, 304*b* to receive multiple ones of the domes 20. If desired, the clamps 302, 304 can also include cavities spaced apart from one another along a width thereof to align with the radial areas 22 and/or the field areas 24 of the tile 10. With this configuration, securing the end edges 312 of the tile 10 within the clamps 302, 304 and stretching the tile 10 will not damage or minimize deformation of the tactile portions 16. The clamps 302, 304 can be configured to apply a sufficient clamping force so that the clamps 302, 304 can retain the tile 10 therebetween during the stretching operation without slippage. In some versions, however, the tile 10 may slip slightly during the stretching operation and advantageously edges of the domes 20, and/or other tactile portions 16, can engage surfaces of the cavities 314 to further retain the tile 10 between the clamps 302, 304. If desired, engagement surfaces 302*c*, 304*c* of the clamps 302, 304 can include roughened or tacky portions or materials disposed thereon or formed therein to aid in gripping the tile 10. In further versions, members 302*a*, 302*b*, 304*a*, 304*b* of the clamps 302, 304 opposite the cavities 314 can include protrusions 315 that align with the cavities 314. The protrusions 315 can have shapes that are generally complementary to the tactile portions 16 so that when the end edge portions 312 of the tile 10 are clamped therebetween, the tactile portions 16 are secured within a connection between the protrusions 315 and the cavities 314.

After the tile 10 is secured between the clamps 302, 304, a user can operate the one or more hydraulic cylinders 306 to shift the mobile clamp 304 away from the stationary clamp 302 to thereby stretch the tile 10 to the yield point to eliminate stresses introduced to the tile 10 as a result of the tactile portion 16 formation process. The hydraulic cylinders 306 can be configured to provide a sufficient force to overcome the tensile strength of the steel to stretch the tile. In some versions, the hydraulic cylinders 306 can be configured to apply at least 100 tons of force.

As shown in FIG. 45, the assembly 300 can be configured to ensure that the mobile clamp 304 shifts horizontally during the stretching operation without undesired tilting. In one approach, the mobile clamp 304 can include a flange or other portion 316 that projects under or engages guides 318 on either side of the work surface 310 of the assembly 300. The guides flanges 316 and guides 318 interact to restrict movement of the mobile clamp 304 to a generally vertical, e.g., within 0-3 degrees from vertical, orientation during the stretching operation.

Stretching the tile 10 removes the memory of the steel imprinted during the preforming and coining operations, allowing the steel to have a desirably flat configuration. Moreover, in many situations, the length of the tile 10 will have a sufficient tolerance to accommodate any stretched length that remains after the hydraulic cylinders 306 are withdrawn. For example, the steel may partially rebound towards the original length. Of course, the end edges 312 can alternatively be trimmed by a suitable press or the length of the tile after formation can be cut to have a smaller dimension than desired in the final stretched tile.

The tile 10 can be stretched a predetermined percentage of its length. For example, the tile 10 can be stretched between about 0.02% and about 0.15% of its length, between about 0.05% and about 0.12% of its length, between about 0.06% and about 0.10% of its length, between about 0.07% and about 0.09% of its length, or about 0.08% of its length. The stretch percentage can be tailored to achieve a desired stress-removal and resulting flatness. This stretching operation can result in a tile having a flatness of below 0.2 and, in some forms, below 0.15.

Moreover, it will be understood that the configurations, and the tactile portions 16 thereof, along with other configurations, shapes, and sizes within the scope of this disclosure, can be compliant to, and configured in accordance with, the requirements set forth in the Americans with Disabilities Act (ADA) of 1990, 42 U.S.C. § 12101, as well as any state and local laws and regulations.

Additionally, while a particularly-preferred embodiment of a detectable warning tile is illustrated in the drawings of the present disclosure, it will be understood that the functional features disclosed and claimed herein can be accomplished with tiles having surface designs that differ ornamentally from the detectable warning tiles illustrated in the drawings of the present disclosure, and the ornamental features of the detectable warning tiles illustrated in the drawings are not dictated by function.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A method for forming a detectable warning tile from a sheet of steel using a progressive die, the method comprising:

feeding the sheet of steel through the progressive die using a feeding mechanism;

preforming structures across a width and length of the sheet of steel using one or more first workstations of the progressive die, the structures including domes; and coining the structures to form an array of tactile portions in the sheet of steel using one or more second workstations of the progressive die, the tactile portions including truncated domes resulting from coining the domes.

2. The method of claim 1, wherein coining the structures includes forming nibs in a top surface of each of the tactile portions.

3. The method of claim 1, wherein feeding the sheet of steel through the progressive die using the feeding mechanism further comprises:

feeding the sheet of steel from a coiled configuration; and flattening the sheet of steel.

4. The method of claim 1, wherein coining the structures to form the truncated domes comprises coining the structures to form truncated domes having wall portions of varying thicknesses.

5. The method of claim 1, wherein coining the structures to form the array of tactile portions further includes coining a portion of the structures to form a plurality of radial tactile portions that extend radially away from each of the truncated domes.

6. The method of claim 5, wherein coining the structures to form the array of tactile portions further includes coining a second portion of the structures to form field tactile portions having a different configuration than the truncated dome and radial tactile portions.

7. The method of claim 1, wherein coining the structures to form the array of tactile portions further includes coining a portion of the structures and adjusting a height of the portion of the structures to counteract growth in the sheet of steel resulting from forming the truncated domes.

8. The method of claim 1, wherein preforming the structures across the width and length of the sheet of steel comprises using a plurality of first workstations, each of the plurality of first workstations having one or more punch and die pairs disposed so to distribute the preforming of the structures along a length and width of the progressive die.

9. The method of claim 8, wherein preforming the structures across the width and length of the sheet of steel using the one or more first workstations of the progressive die comprises preforming a same structure or combination of structures with each of the one or more first workstations.

10. The method of claim 1, wherein preforming the structures comprises preforming structures that have a generally constant thickness.

11. The method of claim 10, wherein coining the structures to form the array of tactile portions includes coining the domes to form the truncated domes including a top wall having a thickness that is less than the general constant thickness of the structures.

12. The method of claim 1, wherein coining the structures comprises using a plurality of second workstations, each of the plurality of second workstations having one or more punch and die pairs disposed so to distribute the coining of the structures along a length and width of the progressive die.

13. The method of claim 1, wherein coining the structures to form the array of tactile portions in the sheet of steel using the one or more second workstations of the progressive die comprises coining a same tactile portion or combination of tactile portions with each of the one or more second workstations.

14. The method of claim 1, further comprising leveling the sheet of steel by forming a leveling rib extending across the width of the sheet of steel.

15. The method of claim 14, wherein leveling the sheet of steel by forming the leveling rib further comprises adjusting a height of the leveling rib to counteract growth in the sheet of steel resulting from coining the structures.

16. The method of claim 1, further comprising coining longitudinal edges of the sheet of steel in one or more of the first and second workstations of the progressive die.

17. The method of claim 1, further comprising cutting the sheet of steel to a desired length for the detectable warning tile.

18. The method of claim 17, wherein cutting the sheet of steel comprises cutting the sheet of steel transversely thereacross such that the detectable warning tile has a rectangular configuration.

19. The method of claim 17, wherein cutting the sheet of steel comprises cutting the sheet of steel with two blades at angles with respect to one another such that the detectable warning tile has a wedge-shaped configuration.

20. The method of claim 17, further comprising coining end edges of the detectable warning tile using a single strike die.

21. The method of claim 17, further comprising stretching the detectable warning tile to reduce or remove stresses in the steel resulting from the preforming and coining steps.

22. The method of claim 21, wherein stretching the detectable warning tile comprises:

clamping end edge portions of the detectable warning tile between a stationary clamp and a mobile clamp; and driving movement of the mobile clamp away from the stationary clamp.

23. The method of claim 22, wherein clamping end edge portions of the detectable warning tile between the stationary clamp and the mobile clamp further comprises receiving one or more of the tactile portions in cavities of the stationary clamp and mobile clamp.

24. The method of claim 1, wherein preforming the structures across the width and length of the sheet of steel using the one or more first workstations of the progressive die comprises preforming structures across the width and length of the sheet of steel using the one or more first workstations associated with an upstream portion of the progressive die; and coining the structures to form the array of tactile portions in the sheet of steel using the one or more second workstations of the progressive die comprises coining the structures to form the array of tactile portions in the sheet of steel using one or more second workstations at least partially associated with a downstream portion of the progressive die, the upstream and downstream portions of the progressive die separated by an intermediate, idle portion.

25. The method of claim 24, wherein coining the structures to form the array of tactile portions in the sheet of steel using the one or more second workstations of the progressive die further comprises coining at least one tactile portion in the sheet of steel using one or more of the second workstations associated with the upstream portion of the progressive die.

26. The method of claim 1, further comprising:

punching pilot holes in lateral edge portions of the sheet of steel at a workstation of the progressive die with pilot punches; and registering the sheet of steel with registering punches extending through the pilot holes at one or more downstream workstations of the progressive die.

27. The method of claim 26, wherein punching the pilot holes in the lateral edge portions of the sheet of steel comprises punching pilot holes in an excess width lateral edge portion of the sheet of steel; and further comprising trimming the excess width lateral edge portion off the sheet of steel.

28. The method of claim 27, wherein trimming the excess width lateral edge portion off the sheet of steel comprises trimming the excess width lateral edge portion of the sheet of steel with a trimming tool at a workstation of the progressive die.

29. The method of claim 28, wherein registering the sheet of steel with the pilot punches comprises registering the sheet of steel with pilot punches disposed at a workstation within two workstations of the trimming tool.

30. The method of claim 26, wherein registering the sheet of steel with the pilot punches at the one or more downstream workstations comprises registering the sheet of steel with the pilot punches in one or more of the second workstations.

31. A detectable warning tile made from the method of claim 1, the detectable warning tile comprising:

a steel body;

a generally planar base portion of the steel body; and a plurality of truncated domes of the steel body projecting upwardly from the generally planar base, the plurality of truncated domes each having a sidewall and a top wall.

32. The detectable warning tile of claim 31, wherein the sidewall of each truncated dome has a greater thickness than the top wall.

33. The detectable warning tile of claim 31, wherein the sidewall of each truncated dome has a convex configuration.

34. The detectable warning tile of claim 31, further comprising a plurality of radial areas of the steel body projecting upwardly from the generally planar base and projecting radially outwardly from each of the plurality of truncated domes.

35. The detectable warning tile of claim 34, wherein at least one of the plurality of truncated domes, the plurality of field areas, or the plurality of radial areas include one or more upwardly projecting nibs.

36. The detectable warning tile of claim 31, wherein the generally planar base portion of the steel body has a rectangular configuration.

37. The detectable warning tile of claim 31, wherein the generally planar base portion of the steel body has a wedge-shaped configuration.

38. The detectable warning tile of claim 31, wherein edges of the steel body are chamfered.

39. The detectable warning tile of claim 31, further comprising a leveling rib or recess extending laterally across the steel body.

40. The detectable warning tile of claim 31, wherein a cross-sectional gauge of the steel body is about 0.002" or less.

41. The detectable warning tile of claim 31, wherein a cross-sectional gauge of the steel body is about 0.0015" or less.

42. The detectable warning tile of claim 31, wherein edges of the sidewalls of each of the truncated domes are coined edges.

43. The detectable warning tile of claim 34, wherein the plurality of field areas and the plurality of radial areas each have a sidewall and a top wall, and edges of the sidewalls of each of the truncated domes, the plurality of field areas, and the plurality of radial areas are coined edges.

44. The detectable warning tile of claim 34, wherein the plurality of radial areas have a track shape extending radially outwardly from the each of the plurality of truncated domes.

* * * * *